US007251420B2

(12) United States Patent
Fujimori et al.

(10) Patent No.: US 7,251,420 B2
(45) Date of Patent: Jul. 31, 2007

(54) METHOD AND APPARATUS FOR IMAGE FORMING CAPABLE OF EFFECTIVELY DETECTING TONER DENSITY

(75) Inventors: Kohta Fujimori, Kanagawa-ken (JP); Shin Hasegawa, Chiba-ken (JP); Noboru Sawayama, Tokyo-to (JP); Shinji Kato, Kanagawa-ken (JP); Hitoshi Ishibashi, Kanagawa-ken (JP); Kayoko Tanaka, Chiba-ken (JP); Yushi Hirayama, Tokyo-to (JP); Takashi Enami, Kanagawa-ken (JP); Shinji Kobayashi, Kanagawa-ken (JP); Kazumi Kobayashi, Tokyo-to (JP); Fukutoshi Uchida, Kanagawa-ken (JP); Naoto Watanabe, Chiba-ken (JP)

(73) Assignee: Ricoh Company, Ltd., Tokyo (JP)

( * ) Notice: Subject to any disclaimer, the term of this patent is extended or adjusted under 35 U.S.C. 154(b) by 83 days.

(21) Appl. No.: 11/169,670

(22) Filed: Jun. 30, 2005

(65) Prior Publication Data

US 2006/0002724 A1 Jan. 5, 2006

(30) Foreign Application Priority Data

Jun. 30, 2004 (JP) ..... 2004-194857
Feb. 28, 2005 (JP) ..... 2005-054815

(51) Int. Cl.
*G03G 15/08* (2006.01)
*G03G 15/00* (2006.01)
*G03G 15/10* (2006.01)

(52) U.S. Cl. ..... 399/27; 399/49; 399/58; 399/254; 399/258

(58) Field of Classification Search ..... 399/27, 399/30, 49, 53, 58, 60, 61, 62, 254, 255, 399/258

See application file for complete search history.

(56) References Cited

U.S. PATENT DOCUMENTS 5,198,861 A 3/1993 Hasegawa et al.

(Continued)

FOREIGN PATENT DOCUMENTS

JP 11-272064 10/1999

(Continued)

OTHER PUBLICATIONS

U.S. Appl. No. 11/083,138, filed Mar. 18, 2005, Hasegawa et al.

(Continued)

*Primary Examiner*—Sandra L. Brase
(74) *Attorney, Agent, or Firm*—Oblon, Spivak, McClelland, Maier & Neustadt, P.C.

(57) ABSTRACT

An image forming apparatus includes an image forming mechanism and a control device. The image forming mechanism performs an image forming operation under predetermined image forming conditions, and includes an image carrying member for forming an electrostatic latent image thereon, a development device for developing the electrostatic latent image into a toner image, and a transfer device for transferring the toner image to a recording medium. The control device controls an amount of toner replenished to the development device, sets a developer mixing time for evenly mixing developer in the development device, causes the development device to mix the developer for the set developer mixing time, causes the image forming mechanism to form toner image patterns, detects the toner image patterns, and determines the predetermined image forming conditions based on the detection of the toner image patterns. An image forming method is also described.

30 Claims, 16 Drawing Sheets

U.S. PATENT DOCUMENTS

| | | | | |
|---|---|---|---|---|
| 5,227,842 | A | | 7/1993 | Hayashi et al. |
| 5,237,369 | A | | 8/1993 | Maruta et al. |
| 5,270,783 | A | | 12/1993 | Bisaiji et al. |
| 5,293,198 | A | | 3/1994 | Sawayama et al. |
| 5,327,196 | A | | 7/1994 | Kato et al. |
| 5,387,965 | A | | 2/1995 | Hasegawa et al. |
| 5,486,901 | A | * | 1/1996 | Fukuchi et al. ..... 399/58 X |
| 5,630,195 | A | | 5/1997 | Sawayama et al. |
| 5,857,131 | A | | 1/1999 | Hasegawa |
| 5,860,038 | A | | 1/1999 | Kato et al. |
| 5,937,229 | A | * | 8/1999 | Walgrove et al. ..... 399/49 X |
| 5,970,276 | A | * | 10/1999 | Kato ..... 399/49 X |
| 6,148,161 | A | * | 11/2000 | Usui et al. ..... 399/58 |
| 6,160,569 | A | | 12/2000 | Fujimori et al. |
| 6,496,677 | B2 | | 12/2002 | Fujimori |
| 6,526,235 | B2 | | 2/2003 | Kato |
| 6,594,453 | B2 | | 7/2003 | Kato |
| 2004/0251435 | A1 | | 12/2004 | Sawayama et al. |
| 2005/0019048 | A1 | | 1/2005 | Kato |
| 2005/0141907 | A1 | | 6/2005 | Izumikawa et al. |
| 2005/0147424 | A1 | | 7/2005 | Kato et al. |

FOREIGN PATENT DOCUMENTS

| | | |
|---|---|---|
| JP | 2003-57950 | 2/2003 |
| JP | 2004-4961 | 1/2004 |

OTHER PUBLICATIONS

U.S. Appl. No. 11/477,673, filed Jun. 30, 2006, Watanabe, et al.
U.S. Appl. No. 11/582,990, filed Oct. 19, 2006, Watanabe.

* cited by examiner

| FIG. 6A |
| --- |
| FIG. 6B |

CHANGES OF TONER DENSITY OVER TIME
WITH RESPECT TO DIFFERENT DEVELOPER USE HISTORIES
TONER REPLENISHMENT AMOUNT=300mg

CHANGES OF TONER DENSITY OVER TIME WITH RESPECT TO
DIFFERENT TONER CONSUMPTION AMOUNTS

CHANGES OF TONER DENSITY OVER TIME
WITH RESPECT TO DIFFERENT DEVELOPER USE HISTORIES
TONER CONSUMPTION AMOUNT=300mg

····· DEVELOPER USE HISTORY=0 PAGE
-·-·- DEVELOPER USE HISTORY=10000 PAGES
---- DEVELOPER USE HISTORY=20000 PAGES
—— DEVELOPER USE HISTORY=50000 PAGES

METHOD AND APPARATUS FOR IMAGE FORMING CAPABLE OF EFFECTIVELY DETECTING TONER DENSITY

CROSS-REFERENCE TO RELATED APPLICATIONS

This application claims priority to Japanese patent application nos. 2004-194857 filed on Jun. 30, 2004 and 2005-054815 filed on Feb. 28, 2005, the entire contents of each of which are hereby incorporated by reference herein.

BACKGROUND OF THE INVENTION

1. Field of the Invention

This patent specification relates to an image forming method and apparatus capable of reducing downtime of an image forming apparatus while maintaining toner density stability.

2. Description of the Related Art

In a background image forming apparatus such as a copier and a printer, image forming conditions need to be controlled to maintain toner density of images formed by the background image forming apparatus at a desirable level. The image forming conditions are controlled to appropriately adjust a toner amount by, for example, forming test toner patterns on a non-image area of a toner-image carrying member and detecting an amount of toner adhered to the test toner patterns. Particularly in a full-color image forming apparatus, such detection needs to cover a wide range from relatively high-density parts to relatively low-density parts of an image to maintain density gradation and color reproductivity of the image at desirable levels.

To obtain a toner gradation sequence, a plurality of toner image patterns need to be formed for detection of a wide range from relatively high-density parts to relatively low-density parts of an image. Generally, a plurality of toner image patterns are formed by applying different development bias voltages, different exposure energies, and so forth to a surface of an image carrying member in a rotation direction thereof. Then, the plurality of toner image patterns sequentially reach a detecting position of a toner density sensor, and the toner density sensor sequentially detects toner density values of the respective toner image patterns. In this case, the detection takes a relatively long time and thus may not be performed frequently. Therefore, the detection is performed after printing a predetermined number of sheets or at predetermined time intervals, for example.

According to a two-component development system, toner is mainly consumed as an image forming operation continues to be performed. Therefore, toner is replenished in a development device and is charged by friction together with carrier by using a conveying screw or the like. Then, the toner is conveyed onto a surface of a magnet roller (i.e., a development roller), and toner images are developed thereon. In a small-size image forming apparatus using this system, however, an amount of carrier is limited. As a result, if toner is replenished in the development device in a relatively short time, concentration distribution of toner supplied onto the surface of the magnet roller may temporarily become uneven.

Therefore, in the background image forming apparatus, toner image patterns are formed after having equalized a concentration distribution of toner by rotating a conveying screw provided at an upstream side of a magnet roller to mix and convey the toner and carrier.

For example, if a development device is replenished with its maximum replenishment amount of toner, and if a predetermined time period is set as a time period required for equalizing the concentration distribution of toner, toner image patterns are formed always after the conveying screw has been rotated for the predetermined time period. An amount of toner replenished, however, corresponds to an amount of toner consumed, which relates to a pixel count of images formed on a printed page, for example. Therefore, the amount of toner replenished is not necessarily the maximum replenishment amount. As a result, if the amount of toner replenished in a toner replenishment is smaller than the maximum replenishment amount, the time required for equalizing the concentration distribution of toner which was made uneven by the toner replenishment may be shorter than the above predetermined time period. As in this case, if the time period required for equalizing the concentration distribution of toner is set at a predetermined value, unnecessary downtime of the image forming apparatus results.

To attempt to resolve this problem, there is a technique using a video counter for counting and summing up image data values of images developed by a plurality of development devices, and a developer density detection device for summing up the image data values and detecting information of toner consumption in the developer. In this technique, toner is replenished in accordance with a toner replenishment signal which is based on a signal output from the developer density detection device, and a speed of driving the mixing member can be varied according to a value of the video counter. This technique, however, is to simply optimize the speed of driving the mixing member and is not based on an idea to reduce the downtime of the image forming apparatus while maintaining toner density detection stability.

SUMMARY OF THE INVENTION

This patent specification describes an image forming apparatus. In one example, an image forming apparatus includes an image forming mechanism and a control device. The image forming mechanism is configured to perform an image forming operation under predetermined image forming conditions. The image forming mechanism includes an image carrying member, a development device, and a transfer device. The image carrying member is configured to form an electrostatic latent image thereon. The development device is configured to develop the electrostatic latent image into a toner image. The transfer device is configured to transfer the toner image to a recording medium. The control device is configured to control an amount of toner replenished to the development device, to set a developer mixing time for evenly mixing developer in the development device, to cause the development device to mix the developer for the set developer mixing time, to cause the image forming mechanism to form toner image patterns, to detect the toner image patterns, and to determine the predetermined image forming conditions based on the detection of the toner image patterns.

This patent specification further describes another image forming apparatus. In one example, this image forming apparatus includes an image forming mechanism and a control device. The image forming mechanism includes an image carrying member, a charging device, an exposure device, a development device, a transfer device, and a toner replenishing device. The charging device is configured to charge the image carrying member. The exposure device is configured to expose the image carrying member to form an electrostatic latent image thereon. The development device is configured to develop the electrostatic latent image into a toner image. The development device includes a mixing and conveying device configured to mix and convey developer including carrier and toner, and a development roller configured to carry and supply the mixed and conveyed developer to the image carrying member. The transfer device is configured to transfer the toner image to a recording medium. The toner replenishing device is configured to replenish toner in the development device. The control device is configured to control an amount of toner replenished to the development device, to set a developer mixing time for evenly mixing the developer in the development device, to cause the development device to mix the developer for the set developer mixing time, to cause the image forming mechanism to form toner image patterns, to detect the toner image patterns, and to determine predetermined image forming conditions based on the detection of the toner image patterns.

In the image forming apparatus, the control device may set the developer mixing time based on a state of the development device.

In the image forming apparatus, the control device may calculate, prior to a process control starting point at which a process of determining the image forming conditions starts, a time required for mixing the developer and resolving insufficient toner dispersion caused by a change in a toner amount in the development device, and set the time obtained from the calculation at the process control starting point as the developer mixing time which starts after the process control starting point and finishes before formation of the toner image patterns.

In the image forming apparatus, the control device may calculate, in every printing operation during a time required for mixing the developer and resolving insufficient toner dispersion caused by a maximum change in the toner amount in the development device until the process control starting point, a time required for sufficiently dispersing toner in the developer according to a change in the toner amount, and set the time obtained from the calculation at the process control starting point as the developer mixing time which starts after the process control starting point and finishes before formation of the toner image patterns.

In the image forming apparatus, the control device may calculate the developer mixing time based on a toner replenishment amount in the development device.

In the image forming apparatus, the control device may calculate the developer mixing time based on an image area.

In the image forming apparatus, the control device may calculate the developer mixing time based on a developer use history.

This patent specification further describes an image forming method. In one example, an image forming method includes appropriately controlling an amount of toner replenished, setting a developer mixing time for evenly mixing developer, mixing the developer for the developer mixing time, forming toner image patterns, detecting the toner image patterns, and determining predetermined image forming conditions based on the detection of the toner image patterns.

This patent specification further describes another image forming method. In one example, this image forming method includes: providing an image forming mechanism configured to perform an image forming operation under predetermined image forming conditions, and a control device; providing the image forming mechanism with an image carrying member, a charging device, an exposure device, a development device, a transfer device, and a toner replenishing device; and causing the control device to control an amount of toner replenished to the development device, set a developer mixing time for evenly mixing the developer in the development device, cause the development device to mix the developer for the set developer mixing time, cause the image forming mechanism to form toner image patterns, detect the toner image patterns, and determine predetermined image forming conditions based on the detection of the toner image patterns.

The image forming method may further include causing the control device to set the developer mixing time based on a state of the development device.

The image forming method may further include: calculating, prior to a process control starting point at which a process of determining the image forming conditions starts, a time required for mixing the developer and resolving insufficient toner dispersion caused by a change setting the time obtained from the calculation at the process control starting point as the developer mixing time which starts after the process control starting point and finishes before formation of the toner image patterns.

The image forming method may further include: calculating, in every printing operation during a time required for mixing the developer and resolving insufficient toner dispersion caused by a maximum change in the toner amount in the development device until the process control starting point, a time required for sufficiently dispersing toner in the developer according to a change in the toner amount; and setting the time obtained from the calculation at the process control starting point as the developer mixing time which starts after the process control starting point and finishes before formation of the toner image patterns.

The image forming method may further include calculating the developer mixing time based on a toner replenishment amount in the development device.

The image forming method may further include calculating the developer mixing time based on an image area.

The image forming method may further include calculating the developer mixing time based on a developer use history.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE PREFERRED EMBODIMENTS

Figure 1:
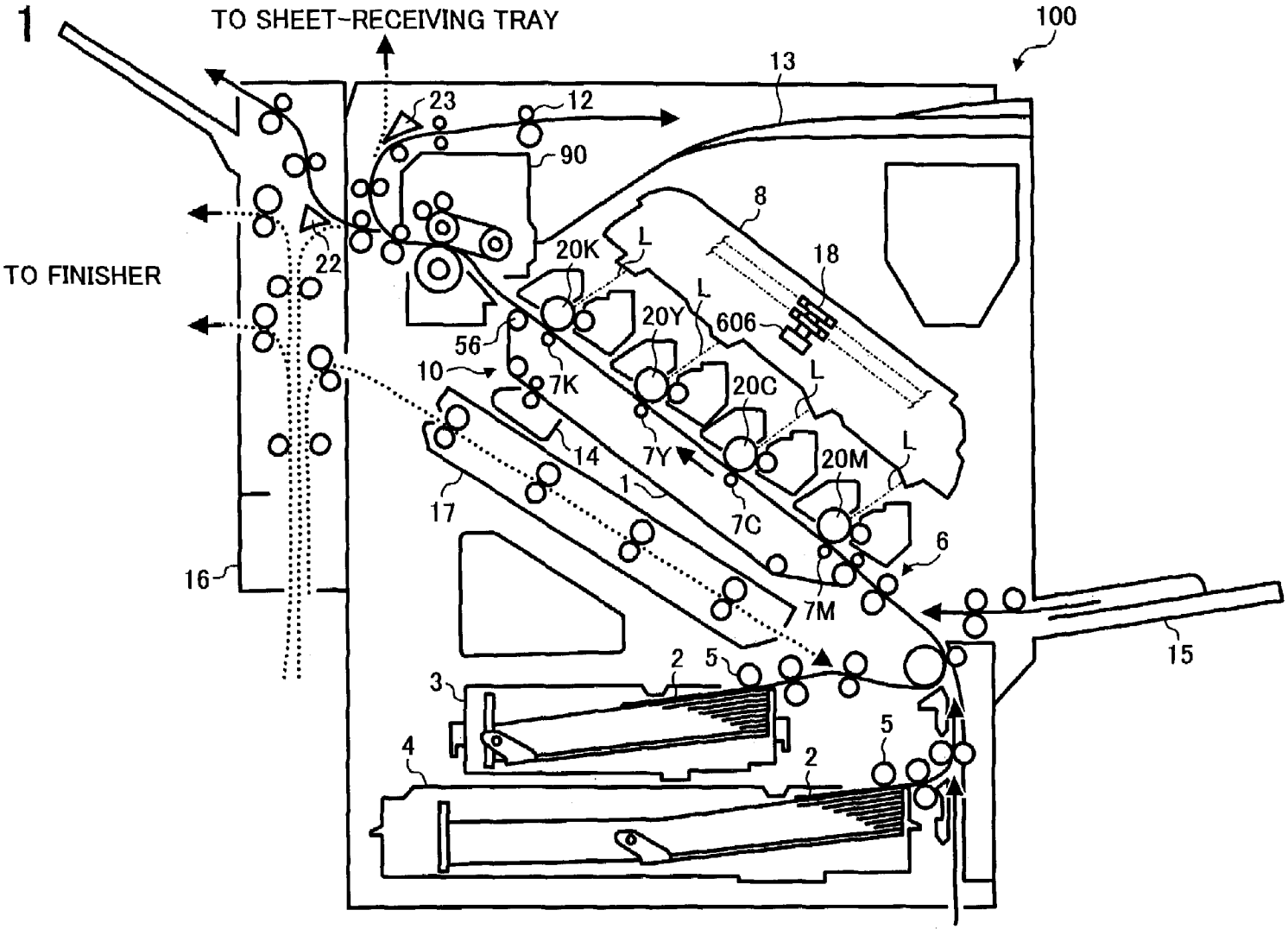
FIG. 1 is a diagram illustrating a configuration of an image forming apparatus according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIG. 1, an image forming apparatus 100 according to an embodiment of the present invention and a process of forming a color image by using the image forming apparatus 100 are described.

The image forming apparatus 100 illustrated in FIG. 1 is an example of a color image forming apparatus and includes a transfer belt 1, sheet-feeding cassettes 3 and 4, a plurality of sheet-feeding rollers 5, a registration roller pair 6, transfer rollers 7K (black), 7Y (yellow), 7C (cyan), and 7M (magenta), a support roller 56, an optical writing device 8, a transfer belt device 10, an ejection roller pair 12, an ejection tray 13, a transfer belt cleaning device 14, a hand-feed tray 15, a reversing unit 16, a reversal conveyance unit 17, a polygon mirror 18, a polygon motor 606, photoconductor drums 20K, 20Y, 20C, and 20M, and a fixing device 90. The sheet-feeding cassettes 3 and 4 store sheets of a recording medium 2.

In the image forming apparatus 100, the transfer belt 1 is provided in the transfer belt device 10, and the photoconductor drums 20K, 20Y, 20C, and 20M which serve as image carrying members are included in respective four image forming stations.

Figure 2:
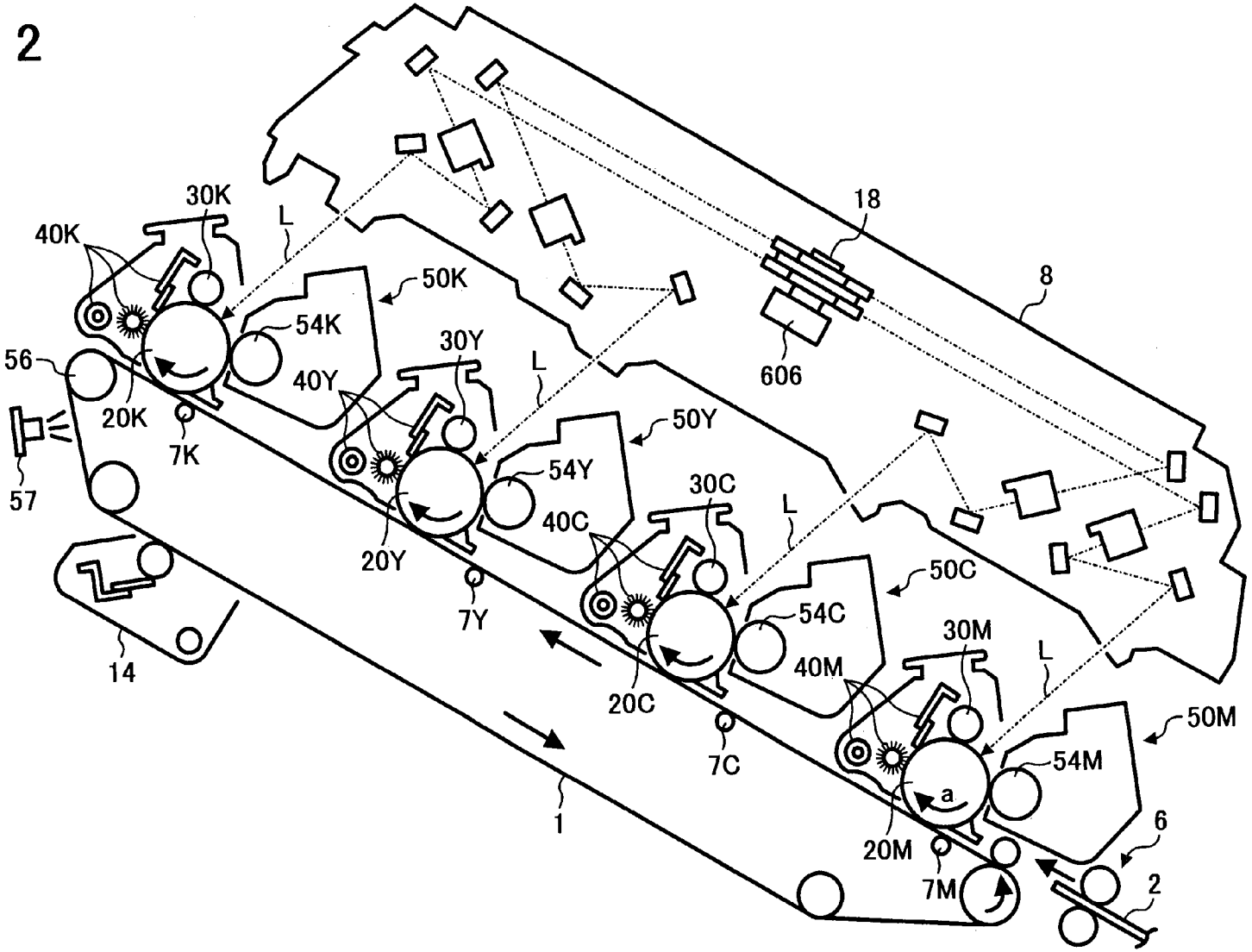
FIG. 2 is a diagram illustrating a configuration of an image forming unit of the image forming apparatus of FIG. 1.
Figure 3:
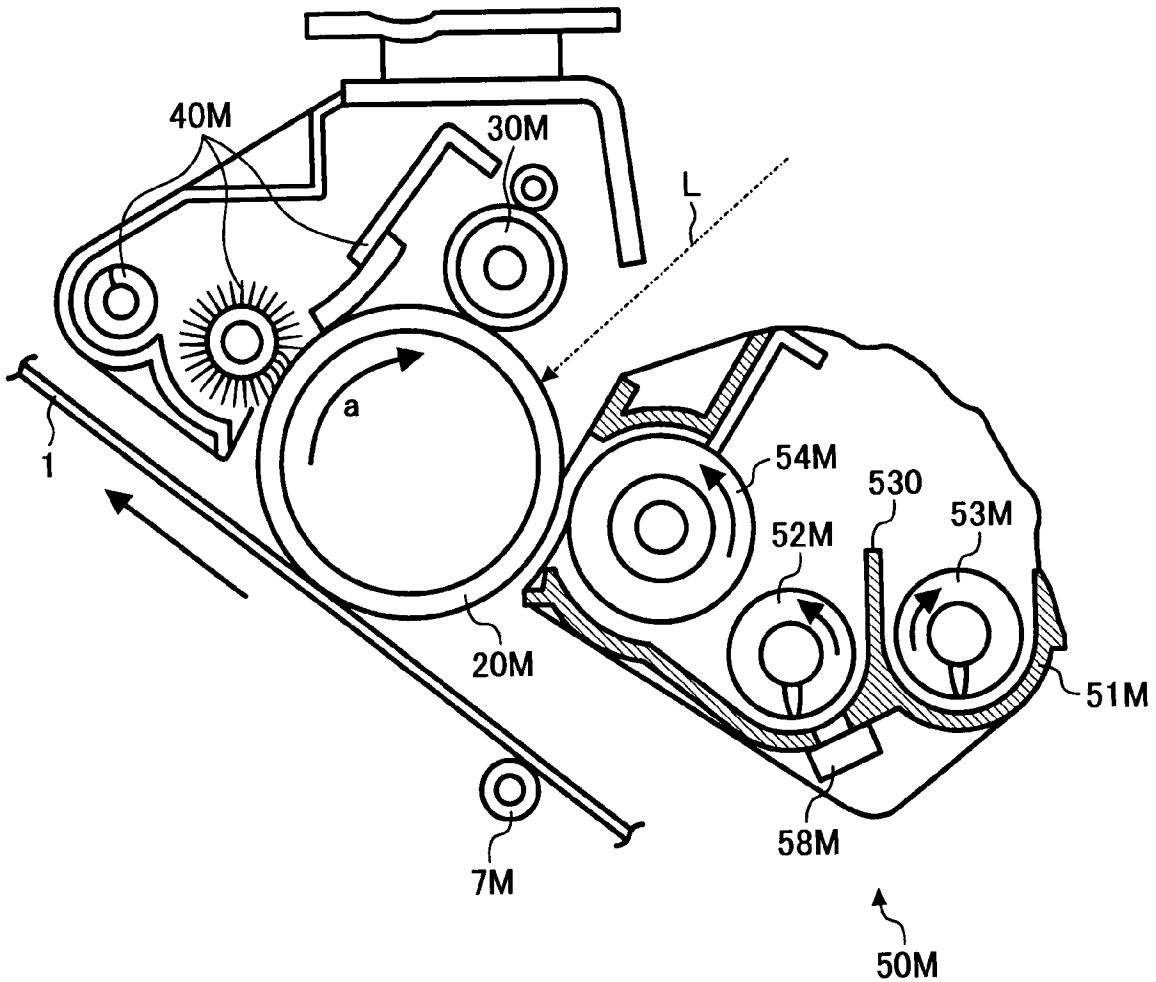
FIG. 3 is a diagram illustrating a configuration of components surrounding a photoconductor drum used in the image forming apparatus of FIG. 1.

FIG. 2 is an enlarged view of main parts of the image forming apparatus 100 of FIG. 1 involving such processes as a charging process, an exposure process, and a transfer process of an image forming operation. To illustrate a development device used in the image forming apparatus 100, FIG. 3 illustrates a development device 50M provided for the photoconductor drum 20M, as an example. Components around the photoconductor drum 20M are similar in structure to components around each of the other photoconductor drums 20K, 20Y, and 20C. Therefore, the following description of the photoconductor drum 20M and its surrounding components also applies to the other photoconductor drums 20K, 20Y, and 20C and their surrounding components.

As illustrated in FIGS. 2 and 3, the photoconductor drum 20M is driven to rotate in a direction indicated by an arrow "a". The photoconductor drum 20M is surrounded by a charging device 30M, the development device 50M, and a cleaning device 40M in the rotation direction of the photoconductor drum 20M. A charging roller is used as the charging device 30M which charges the photoconductor drum 20M. The development device 50M develops an electrostatic latent image formed on the photoconductor drum 20M by exposure. The charging device 30M and cleaning device 40M are housed in a single case. The optical writing device 8 applies a scanning light beam L onto a surface of the photoconductor drum 20M between the charging device 30M and the development device 50M. Accordingly, the surface of the photoconductor drum 20M is exposed and scanned.

With reference to FIG. 1, the image forming operation is briefly described.

A sheet of the recording medium 2 stored in one of the sheet-feeding cassette 3, the sheet-feeding cassette 4, or the hand-feed tray 15 is sent out by the corresponding sheet-feeding roller 5. When a leading end of the recording medium 2 reaches the registration roller pair 6, a sensor (not illustrated) detects arrival of the recording medium 2. The registration roller pair 6 conveys the recording medium 2 to a nip formed by the transfer belt 1 and each of the transfer rollers 7K, 7Y, 7C, and 7M at an appropriate timing according to a detection signal output from the sensor. The transfer rollers 7K, 7Y, 7C, and 7M, which are examples of transfer devices, transfer developed toner images to the recording medium 2.

The photoconductor drums 20K, 20Y, 20C, and 20M are uniformly charged by the corresponding charging devices 30K, 30Y, 30C, and 30M and then exposed and scanned by respective scanning light beams L applied by the optical writing device 8 which exposes the photoconductor drums 20K, 20Y, 20C, and 20M. As a result, electrostatic latent images are formed on the photoconductor drums 20K, 20Y, 20C, and 20M, respectively.

The electrostatic latent images thus formed on the photoconductor drums 20K, 20Y, 20C, and 20M are then developed by corresponding development rollers 54K, 54Y, 54C, and 54M which are included in the development devices 50K, 50Y, 50C, and 50M, respectively. As a result, toner images of respective colors, i.e., black, yellow, cyan, and magenta, are formed on surfaces of the photoconductor drums 20K, 20Y, 20C, and 20M, respectively.

The transfer rollers 7K, 7Y, 7C, and 7M are applied with voltages, and the toner images formed on the surfaces of the photoconductor drums 20K, 20Y, 20C, and 20M are sequentially transferred onto the recording medium 2 which is conveyed by the transfer belt 1. The respective toner images are formed on the surfaces of the photoconductor drums 20K, 20Y, 20C, and 20M at different times such that the toner images are aligned at the same position on the recording medium 2 conveyed on the transfer belt 1.

When the recording medium 2 passes the photoconductor drum 20K, which is the last photoconductor drum in the transfer process, the toner images of the respective colors have been printed on the recording medium 2. The recording medium 2 on which the toner images of the respective colors are transferred is then separated from the transfer belt 1 due to a curvature of the support roller 56 supporting the transfer belt 1. The recording medium 2 is conveyed into the fixing device 90, and the toner images are fixed by heat to the recording medium 2. Thereafter, the recording medium 2 is conveyed by the ejection roller pair 12 into the ejection tray 13 to be stored therein. Alternatively, the recording medium 2 may be differently directed by a direction-switching claw 22 and sent to a finisher (not illustrated) to be subjected to a post-process such as stapling and punching. Still alternatively, the recording medium 2 may be differently directed by a direction-switching claw 23 and sent to another sheet-receiving tray such as a 4-bin print post (not illustrated).

After the toner images are transferred from the photoconductor drums 20K, 20Y, 20C, and 20M to the recording medium 2, toner remaining on the photoconductor drums 20K, 20Y, 20C, and 20M is cleaned by the cleaning devices 40K, 40Y, 40C, and 40M in preparation for a next image forming operation. Toner remaining on the transfer belt 1 is cleaned by the transfer belt cleaning device 14 in preparation for the next image forming operation.

The image forming apparatus 100 is capable of two-side printing. In the two-side printing, after toner images are fixed on one side of the recording medium 2, the direction-switching claw 22 guides the recording medium 2 into the reversing unit 16 to reverse the recording medium 2. The recording medium 2 thus reversed is conveyed into the reversal conveyance unit 17 and sent back to the registration roller pair 6. Thereafter, toner images are formed on the other side of the recording medium 2 according to the image forming procedure described above. Accordingly, toner images are formed on both sides of the recording medium 2.

The optical writing device 8 is described with reference to FIG. 2. The optical writing device 8 includes laser diodes (not illustrated) for the respective toner colors. The laser diodes are controlled by an LD (laser diode) control part (not illustrated) and emit the scanning light beam L at an appropriate timing with conveyance of the recording medium 2. The scanning light beam L is applied to each of the photoconductor drums 20K, 20Y, 20C, and 20M via such lenses as a cylinder lens (not illustrated) which adjusts a diameter of the scanning light beam L, the polygon mirror 18 which rotates to perform scanning in a main-scanning line direction, and an fθ (theta) lens (not illustrated). The polygon mirror 18 is driven and rotated by the polygon motor 606. The LD control part is provided in the vicinity of the optical writing device 8 and controlled by a control device 700 illustrated in FIG. 14.

The transfer belt 1 is described with reference to FIGS. 1 and 2. The transfer rollers 7K, 7Y, 7C, and 7M are provided on an inner side of the transfer belt 1 and apply transfer bias voltages to the transfer belt 1. As a result, the toner images formed on the photoconductor drums 20K, 20Y, 20C, and 20M are transferred to the recording medium 2 which is absorbed to and conveyed by the transfer belt 1. As illustrated in FIG. 2, a P sensor (photo sensor) 57 is provided close to and at a downstream side of the support roller 56 which supports the transfer belt 1 and is provided close to and at a downstream position of the photoconductor drum 20K which is included in the last image forming station (i.e., the image forming station for forming black toner images). The P sensor 57 detects the toner density, for example, of patch patterns (i.e., the toner image patterns) developed on the transfer belt 1. Data detected by the P sensor 57 can be used for image correction, alignment correction, and so forth.

The development devices 50K, 50Y, 50C, and 50M are described with reference to FIGS. 3, 4A, and 4B. The following description of the development device 50M also applies to the other development devices 50K, 50Y, and 50C.

The development device 50M includes a casing 51M, a left conveying screw 52M, a right conveying screw 53M, the development roller 54M, a T sensor (toner density sensor) 58M, and a partition 530.

A dry two-component magnetic brush development system is used in the development device 50M to respond to a relatively high photocopying speed. In the casing 51M, the left conveying screw 52M and the right conveying screw 53M extend in a direction of piercing FIG. 3. The partition 530 partially separates the left conveying screw 52M from the right conveying screw 53M. Axial ends of the left conveying screw 52M and the right conveying screw 53M are, however, not separated from each other by the partition 530.

Figure 4A:
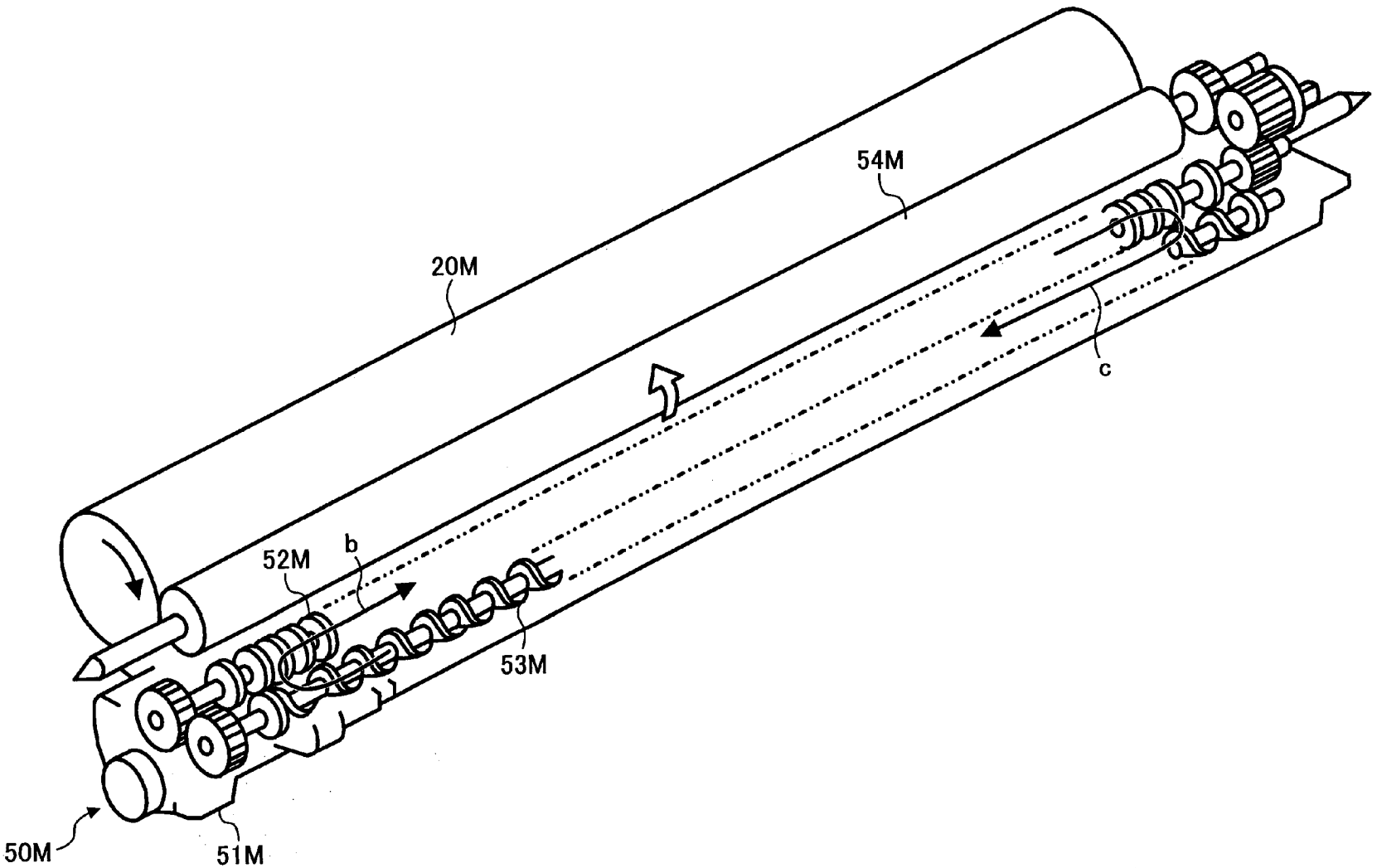
FIG. 4A is a perspective view of a mixing and conveying part of a development device used in the image forming apparatus of FIG. 1.
Figure 4B:
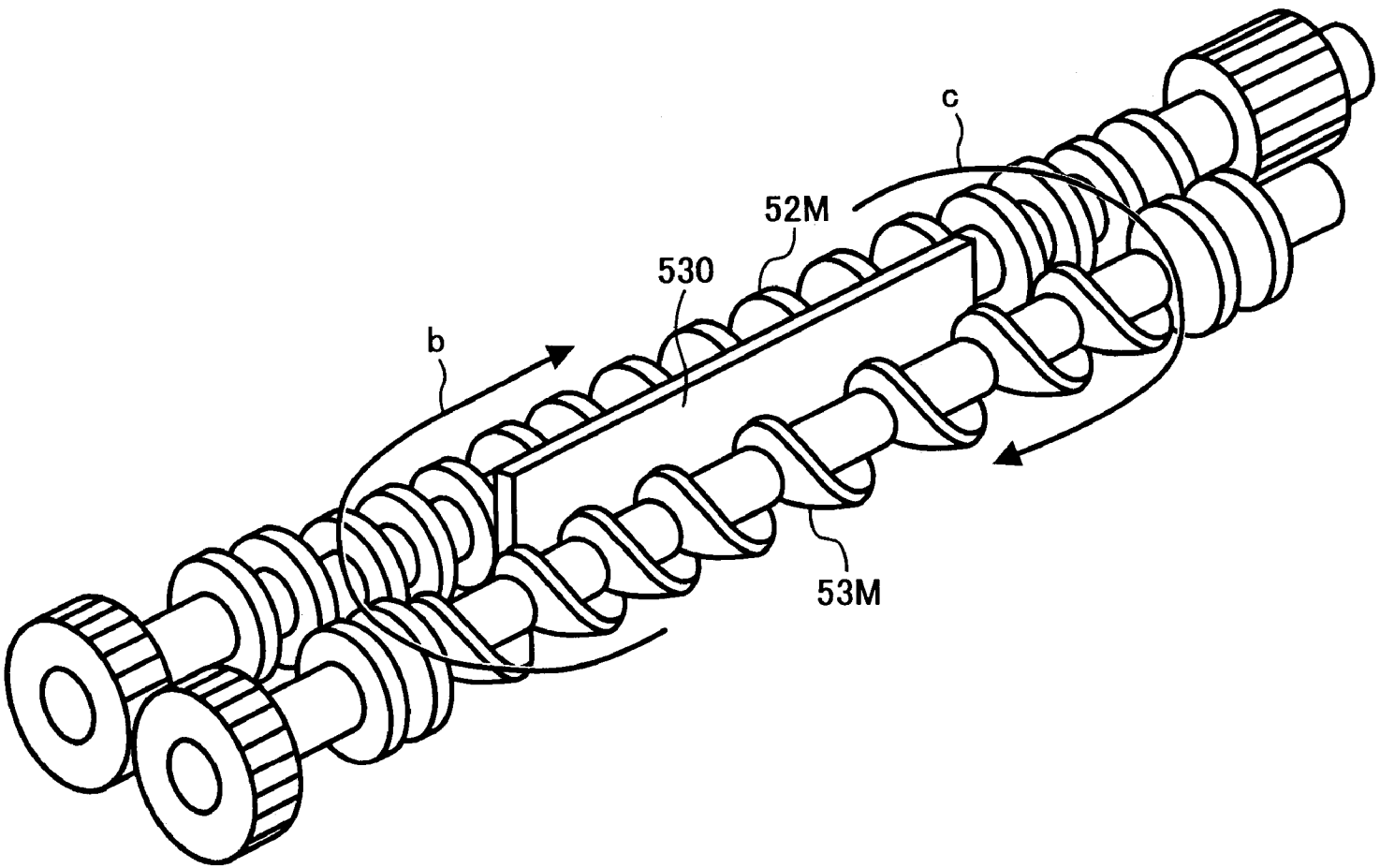
FIG. 4B is a perspective view of a conveying screw included in the mixing and conveying part of FIG. 4A.
Figure 5:
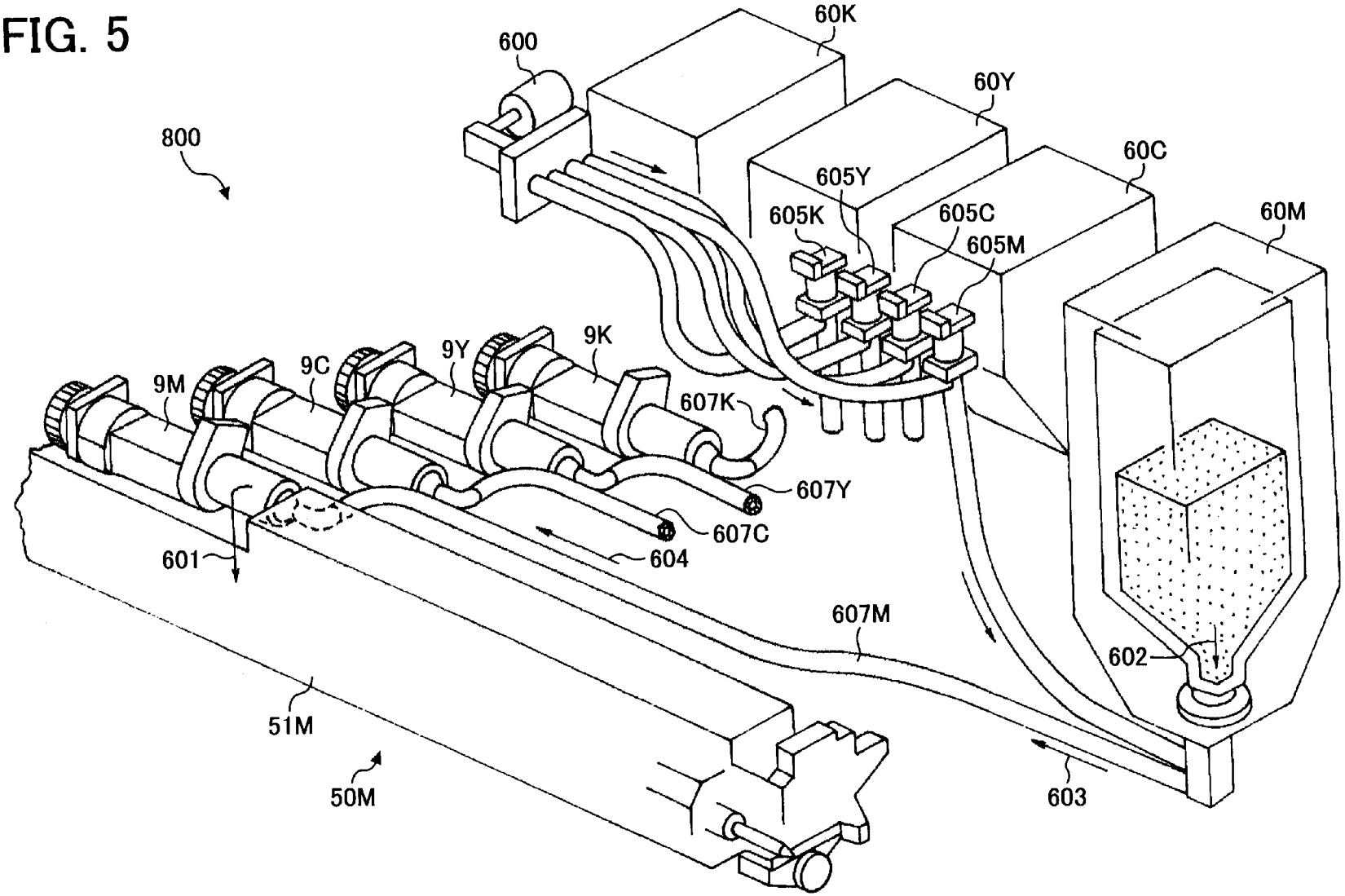
FIG. 5 is a perspective view of a toner replenishing device used in the image forming apparatus of FIG. 1.

As illustrated in FIGS. 4A and 4B, toner conveyed from a toner cartridge 60M illustrated in FIG. 5 into the development device 50M is further conveyed by the left conveying screw 52M and the right conveying screw 53M in a loop direction indicated by arrows "b" and "c". In this toner conveying process, the toner is mixed with a developer including toner and carrier and sent to the development roller 54M which is provided adjacent to and facing the photoconductor drum 20M. The development roller 54M, which includes a magnet to carry the developer, forms a magnetic brush and rotates to supply the photoconductor drum 20M with the developer. Accordingly, an electrostatic latent image formed on the photoconductor drum 20M is developed into a visible image. As illustrated in FIG. 3, the T sensor 58M which detects the toner density of the developer is provided near the left conveying screw 52M in the casing 51M of the development device 50M such that a detection surface of the T sensor 58M protrudes into the casing 51M.

As described above, each of the development devices 50K, 50Y, 50C and 50M is provided with a mixing and conveying part which mixes the developer including carrier and toner and conveys the developer to a development position, and a corresponding one of the development rollers 54K, 54Y, 54C, and 54M which carries and supplies the developer to a corresponding one of the image carrying members (i.e., the photoconductor drums 20K, 20Y, 20C, and 20M). In the development devices 50K, 50Y, 50C and 50M according to the present embodiment, mixing and conveyance of the developer are simultaneously performed. Therefore, such expressions as "mixing and conveyance" and "mixing and conveyance time" may be also understood as "mixing" and "mixing time" throughout the present specification.

A mechanism of toner replenishment to the development devices 50K, 50Y, 50C and 50M is described with reference to FIG. 5. FIG. 5 illustrates main parts of a toner replenishing device 800 which replenishes toner of the respective colors to the development devices 50K, 50Y, 50C and 50M.

The toner replenishing device 800 illustrated in FIG. 5 includes mechanical members such as toner cartridges 60K, 60Y, 60C, and 60M, an air pump 600, air supply valves 605K, 605Y, 605C, and 605M, toner powder conveying pumps 9K, 9Y, 9C, and 9M, and toner conveying pipes 607K, 607Y, 607C, and 607M. The toner replenishing device 800 further includes a toner replenishment amount controlling device (not illustrated in FIG. 5).

The toner replenishing device 800 supplies toner from the toner cartridges 60K, 60Y, 60C, and 60M to the corresponding development devices 50K, 50Y, 50C, and 50M. The toner cartridges 60K, 60Y, 60C, and 60M contain black toner, yellow toner, cyan toner, and magenta toner, respectively, and are detachably provided in the image forming apparatus 100. The following description is made on a system of replenishing the magenta toner to the development device 50M, as an example. The following description therefore applies also to systems of supplying the black toner, the yellow toner, and the cyan toner to the corresponding development devices 50K, 50Y, and 50C.

The magenta toner is conveyed from the toner cartridge 60M to the development device 50M by using the air pump 600 which is also shared by the other toner cartridges 60K, 60Y, and 60C, and by using the toner powder conveying pump 9M. The black toner, the yellow toner, and the cyan toner are conveyed by the air pump 600 and by the respective toner powder conveying pumps (mohno pumps) 9K, 9Y, and 9C.

The toner cartridge 60M has a toner supply port (not illustrated) provided with a sponge valve (not illustrated) which prevents toner from dropping from the toner replenishing port in replacing the toner cartridge 60M with a new toner cartridge. When the toner cartridge 60M is attached to the image forming apparatus 100, a valve of a toner replenishing port of the image forming apparatus 100 opens, and toner drips from the toner cartridge 60M and is sent by the toner powder conveying pump 9M to the development device 50M. The toner is replenished at a position on one side of the casing 51M in the development device 50M. The position is indicated by an arrow 601 in FIG. 5.

In this toner replenishing process, the toner contained in the toner cartridge 60M is stirred by force of air sent from the air pump 600. The air supplied by the air pump 600 is controlled by closing and opening air supply valves 605K, 605Y, 605C, and 605M provided for the respective toner colors. Air is supplied into the respective toner cartridges 60K, 60Y, 60C, and 60M according to toner density control of toner contained in each of the toner cartridges 60K, 60Y, 60C, and 60M.

The toner is suctioned from the toner cartridge 60M by the toner powder conveying pump 9M through the toner conveying pipe 607M, so that the toner flows in an order of arrows 602, 603, 604, and 601 shown in FIG. 5.

As described above, the toner replenishing device 800 includes the mechanical members and the toner replenishment amount controlling device which controls the toner replenishment amount. The control device 700 illustrated in FIG. 14 serves as the toner replenishment amount controlling device and appropriately controls the amount of toner conveyed to each of the development devices 50K, 50Y, 50C, and 50M by controlling the air pump 600, the air supply valves 605K, 605Y, 605C, and 605M, the toner powder conveying pumps 9K, 9Y, 9C, and 9M, and so forth.

Figure 14:
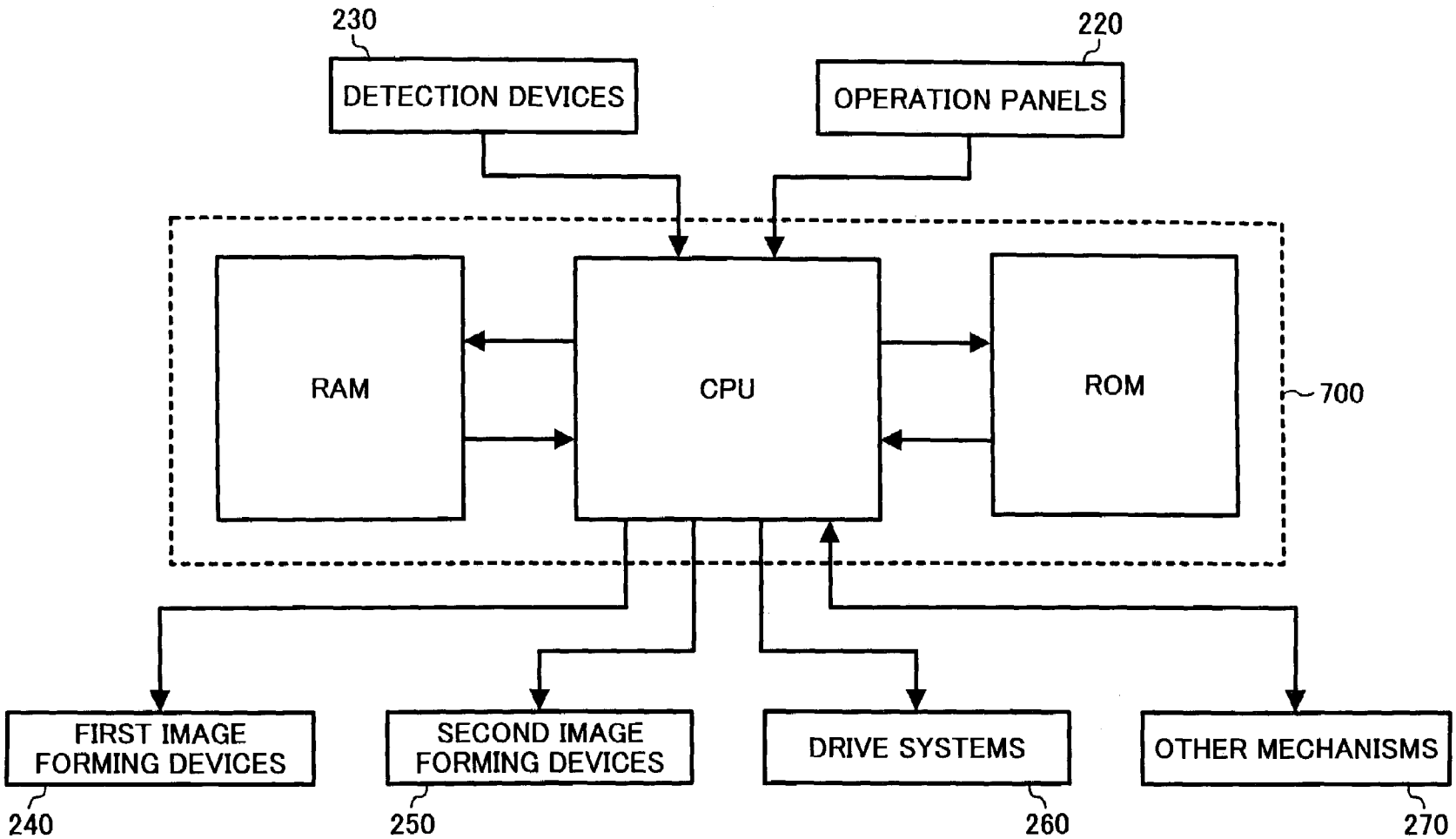
FIG. 14 is a block diagram illustrating a control system of the image forming apparatus of FIG. 1.

The control device 700 illustrated in FIG. 14 also serves as an image forming condition setting device which controls an image forming operation in which toner image patterns are formed on the image carrying members and sets the image forming conditions based on a result of detection of the toner image patterns.

A process in which the image forming condition setting device sets the image forming conditions is described below.

Processes from setting of the developer mixing time to controlling of the toner density are first described. A process control of setting the image forming conditions is performed in such circumstances as at a start-up of the image forming apparatus 100, at an end of a job, at a start of an interrupt printing operation (i.e., at a start of an exposure process), and in a stand-by state of the image forming apparatus 100. In this process control, a CPU (central processing unit) provided in the image forming apparatus 100 controls the image forming operation of forming the toner image patterns on the image carrying members (i.e., the photoconductor drums 20K, 20Y, 20C, and 20M), and sets the image forming conditions such as a development bias voltage and a transfer bias voltage based on a result of detection of the toner image patterns.

Prior to the process control, if the amount of toner contained in each of the development devices 50K, 50Y, 50C, and 50M has changed due to consumption or replenishment of toner, and if the time required for sufficiently mixing the developer has not yet elapsed, the concentration distribution of the toner in the development device is uneven. This unevenness of the toner concentration distribution may be resolved over time by driving the development devices 50K, 50Y, 50C, and 50M to mix and convey the developer. If toner image patterns are formed in a state in which the developers are insufficiently mixed, unevenness of the toner density is observed both temporally and spatially. For example, unevenness of the toner density may be observed between a toner image pattern formed at a given time point and a toner image pattern formed later than the time point. Further, unevenness of the toner density may be observed within a single toner image pattern. Therefore, toner density of toner transferred onto the development rollers 54K, 54Y, 54C, and 54M also becomes uneven. For example, substantially dark toner image patterns or substantially light toner image patterns may be obtained, compared with a case in which the unevenness of the toner density has been resolved over time. If the image forming conditions are set based on the thus formed toner image patterns, the image forming conditions are inappropriately set.

At the start of the process control, therefore, the developer contained in the development devices 50K, 50Y, 50C, and 50M may be sufficiently mixed and conveyed before forming the toner image patterns. If a relatively sufficient and fixed time period is used as the developer mixing time, however, the developer mixing time is wasted and the downtime of the image forming apparatus 100 is increased in such circumstances as when an the replenishment toner amount is relatively small and when a sufficient time has passed since the toner replenishment until the start of the process control and thus mixing of the developer can be completed in a relatively short time.

Accordingly, in an embodiment described below, the developer mixing time actually required is set in consideration of such factors as variation of the toner amount in each of the development devices 50K, 50Y, 50C, and 50M and time elapsed since a change in the toner amount until the start of the process control, so that the toner image patterns are formed after the toner has been mixed and conveyed for the developer mixing time thus set. In the present embodiment, a desirable developer mixing time is determined based on an area of an image to be formed (hereinafter referred to as image area) and a required toner replenishment amount. The toner image patterns are formed after having mixed the developer for the developer mixing time thus determined, and the image forming conditions are set based on detection of the toner image patterns.

FIG. 14 illustrates an exemplary configuration of the control device 700 provided in the image forming apparatus 100 illustrated in FIG. 1. The control device 700 includes the CPU, a RAM (random access memory), and a ROM (read only memory), and is connected to operation panels 220 and detection devices 230. The operation panels 220 include an operation switch involving control of the image forming conditions. The detection devices 230 include sensors provided for the respective development devices 50K, 50Y, 50C, and 50M such as the T sensor 58M, the P sensor 57, and other sensors. With this configuration, the control device 700 receives information sent from the operation panels 220 and the detection devices 230. The control device 700 further exchanges information required for controlling the image forming operation with first image forming devices 240, second image forming devices 250, drive systems 260, and other mechanisms 270. The first image forming devices 240 include members surrounding the photoconductor drums 20K, 20Y, 20C, and 20M and performing such operations as charging, development, transfer, and cleaning. The second image forming devices 250 include other members required for the image forming operation excluding the members included in the first image forming devices 240. The drive systems 260 include a variety of drive systems such as a transfer belt drive system (not illustrated) for driving the transfer belt 1, motors included in the toner replenishing device 800, the polygon motor 606 included in the optical writing device 8, photoconductor drive motors (not illustrated) for driving the photoconductor drums 20K, 20Y, 20C, and 20M, development motors (not illustrated) for driving the development devices 50K, 50Y, 50C, and 50M, and other drive systems. The other mechanisms 270 include, for example, mechanisms for controlling the LD, a charging bias voltage, a development bias voltage, and a transfer bias voltage.

Figure 15:
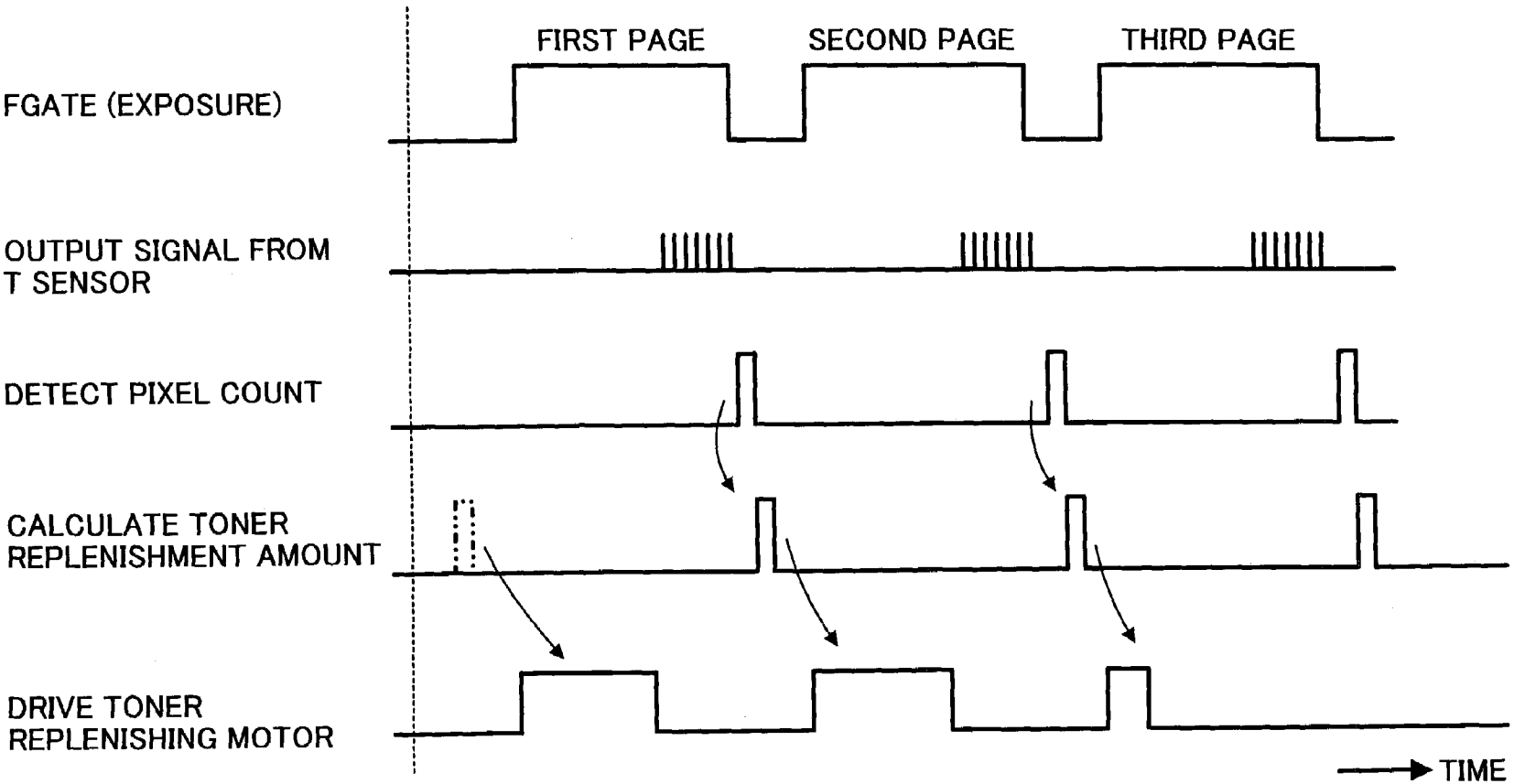
FIG. 15 is a time chart illustrating processes from detection of a pixel count to toner replenishment.

An execution procedure of calculating the image area and the toner replenishment amount is described with reference to a flowchart of FIGS. 6A and 6B and a time chart of FIG. 15.

Figures 6, 6A:
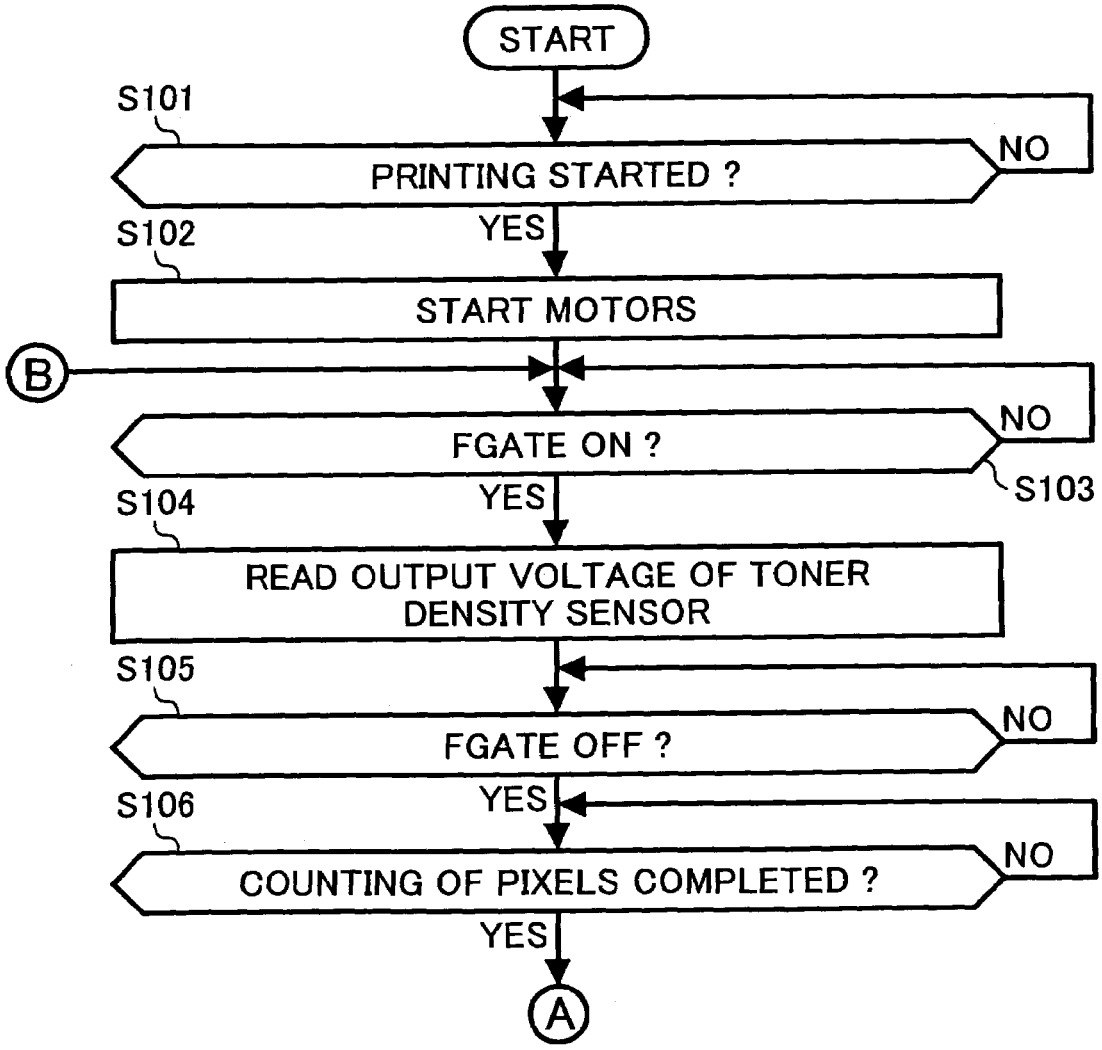
FIGS. 6A and 6B are a flowchart describing a procedure of calculating an image area and a toner replenishment amount.

At Step S101 of the flowchart in FIG. 6A, a printing operation (i.e., an image forming operation) starts. When a start button provided on the image forming apparatus 100 is pressed, or when print data sent from a computer connected to the image forming apparatus 100 is received, the printing operation starts.

At Step S102, a group of motors is driven. When the printing operation starts, the polygon motor 606 is turned on. Then, after the polygon motor 606 has entered into a steady state, the photoconductor drive motors driving the photoconductor drums 20K, 20Y, 20C, and 20M, the development motors driving the development rollers 54K, 54Y, 54C, and 54M, and the transfer belt drive motor driving the transfer belt 1 are turned on. Further, the charging devices 30K, 30Y, 30C, and 30M are applied with a charging bias voltage by a charging bias voltage applying device (not illustrated). Spaces formed between the development rollers 54K, 54Y, 54C, and 54M and their opposed photoconductor drums 20K, 20Y, 20C, and 20M are applied with a development bias voltage by a development bias voltage applying device (not illustrated). The transfer rollers 7K, 7Y, 7C, and 7M are applied with a transfer bias voltage by a transfer bias voltage applying device (not illustrated).

At Step S103, a sub-scanning gate signal FGATE is detected as being ON. When the respective photoconductor drums 20K, 20Y, 20C, and 20M are rotated, charged by the charging devices 30K, 30Y, 30C, and 30M, and prepared for exposure, the sub-scanning gate signal FGATE serving as a reference signal (i.e., a synchronization signal) for starting the printing operation turns ON and rises.

At Step S104, an output voltage output from the T sensor is read in each of the development devices 50K, 50Y, 50C, and 50M. In FIG. 3, in which the development device 50M developing magenta toner images is illustrated as an example, the T sensor 58M is provided in the development device 50M. Similarly, T sensors (not illustrated) are provided in the corresponding development devices 50K, 50Y, and 50C which develop black toner image, yellow toner images, and cyan toner images, respectively. As described above with reference to FIG. 3, the T sensor 58M is provided near the left conveying screw 52M and the right conveying screw 53M in the development device 50M. Therefore, a value of the output voltage output from the T sensor 58M is proportional to permeability of an area near the left conveying screw 52M and the right conveying screw 53M. Since the permeability is inversely proportional to a toner-to-carrier ratio of the developer, the toner density of the developer can be detected from the output voltage output from the T sensor 58M. Detection of the toner density is similarly performed in each of the other development devices 50K, 50Y, and 50C.

At Step S105, the sub-scanning gate signal FGATE is detected as being OFF. When an exposure operation to an image area of a first page is completed, the sub-scanning gate signal FGATE falls and turns OFF, as illustrated in FIG. 15, for example.

At Step S106, a pixel count of the image area is read, and it is determined if the pixel count is completed. The LD control part drives and controls the laser diodes provided in the optical writing device 8 and exposes an image, and the number of pixels included in the exposed image area is counted.

At Step S107, pixel density of the exposed image is determined. Resolution of the exposed image is determined to find whether the pixel count of the exposed image is 600*600 dpi (dots per inch) or 1200*1200 dpi.

At Step S108, an image area of the exposed image is calculated from an equation of IA=PC/PD, wherein IA is an image area, PC is a pixel count, and PD is pixel density. If the pixel count of the exposed image is 600*600 dpi, for example, the image area of the exposed image is 6002/2.542.

At Step S109, the toner replenishment amount is calculated for each of the four kinds of toner by using one of the following four equations of $TRA=IA*PTA*\alpha(Vt-Vref)+\beta(Vt-Vref)$, $TRA=IA*PTA*\alpha$, $TRA=IA*PTA+\beta(Vt-Vref)$, and $TRA=\beta$, wherein TRA is a toner replenishment amount, IA is an image area (cm2), PTA is a per-unit-area toner amount (mg/cm2), Vt is an output voltage actually output from the T sensor, Vref is a target output voltage expected to be output from the T sensor, $\alpha$ is a correction coefficient for such errors as an error in a drive time of each of toner replenishing clutches (i.e., a drive time of each of toner powder conveying pump 9K, 9Y, 9C, or 9M) and an error in rotation of each of the left conveying screw 52M and the right conveying screw 53M, $\beta$ is a correction value for other factors than the image area, such as an amount of toner adhered to non-image areas on the surface of the transfer belt 1, for example. Values of Vref, $\alpha$, and $\beta$, for example, are stored in advance in the CPU as data.

At Step S110, data of the image areas, the output voltages output from the T sensors, the toner replenishment amounts, and so forth are stored in a nonvolatile memory of the CPU.

At Step S111, it is determined whether the printing operation has completed. If it is determined that the printing operation has completed, operation of the group of motors is stopped. If it is determined that the printing operation has not yet completed, on the other hand, toner is replenished in a printing operation to a next page (i.e., the second page) according to a procedure described below, and the Steps S103 through S110 are repeated. In the present embodiment, as illustrated in FIG. 15, toner of the toner replenishment amount determined based on image data of a previous page (i.e., the first page) is replenished at a start of an exposure operation to the next page.

At Step S112, operation of the group of motors is stopped. When the Step S111 has finished, the charging bias voltage applying devices, the development bias voltage applying devices, and the transfer bias voltage applying devices are turned off. Further, the polygon motor 606, the photoconductor drive motors, the development motors, and the transfer belt drive motor are turned off.

Figure 7:
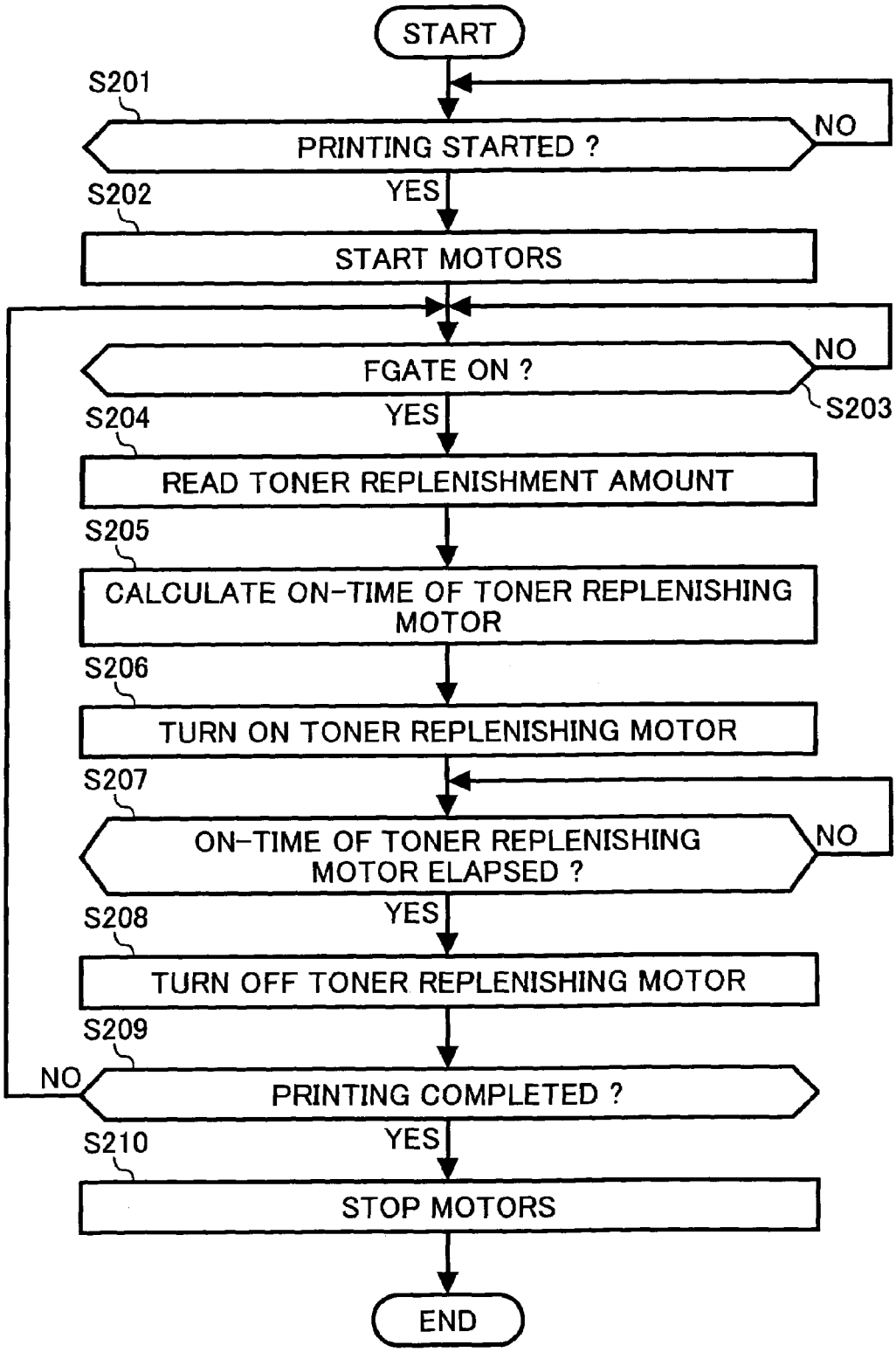
FIG. 7 is a flowchart describing a procedure of executing toner replenishment.

An execution procedure of replenishing toner is described with reference to a flowchart of FIG. 7 and the time chart of FIG. 15.

At Step S201, it is determined if a printing operation starts. When the start button of the image forming apparatus 100 is pressed, or when print data sent from the computer connected to the image forming apparatus 100 is received, the printing operation starts.

At Step S202, the group of motors are driven. When the printing operation starts, the polygon motor 606 is turned on. After the polygon motor 606 has entered into the steady state, the photoconductor drive motors driving the photoconductor drums 20K, 20Y, 20C, and 20M, the development motors driving the development rollers 54K, 54Y, 54C, and 54M, and the transfer belt drive motor driving the transfer belt 1 are turned on. Further, the charging bias voltage applying devices apply charging bias voltages to the respective charging devices 30K, 30Y, 30C, and 30M. The development bias voltage applying devices apply development bias voltages to the spaces formed between the respective development rollers 54K, 54Y, 54C, and 54M and their opposed photoconductor drums 20K, 20Y, 20C, and 20M. The transfer bias voltage applying devices apply transfer bias voltages to the respective transfer rollers 7K, 7Y, 7C, and 7M.

At Step S203, the sub-scanning gate signal FGATE is detected as being ON. When the respective photoconductor drums 20K, 20Y, 20C, and 20M are rotated, charged by the charging devices 30K, 30Y, 30C, and 30M, and prepared for exposure, the sub-scanning gate signal FGATE serving as the reference signal (i.e., the synchronization signal) for starting the printing operation turns ON and rises.

Figure 6B:
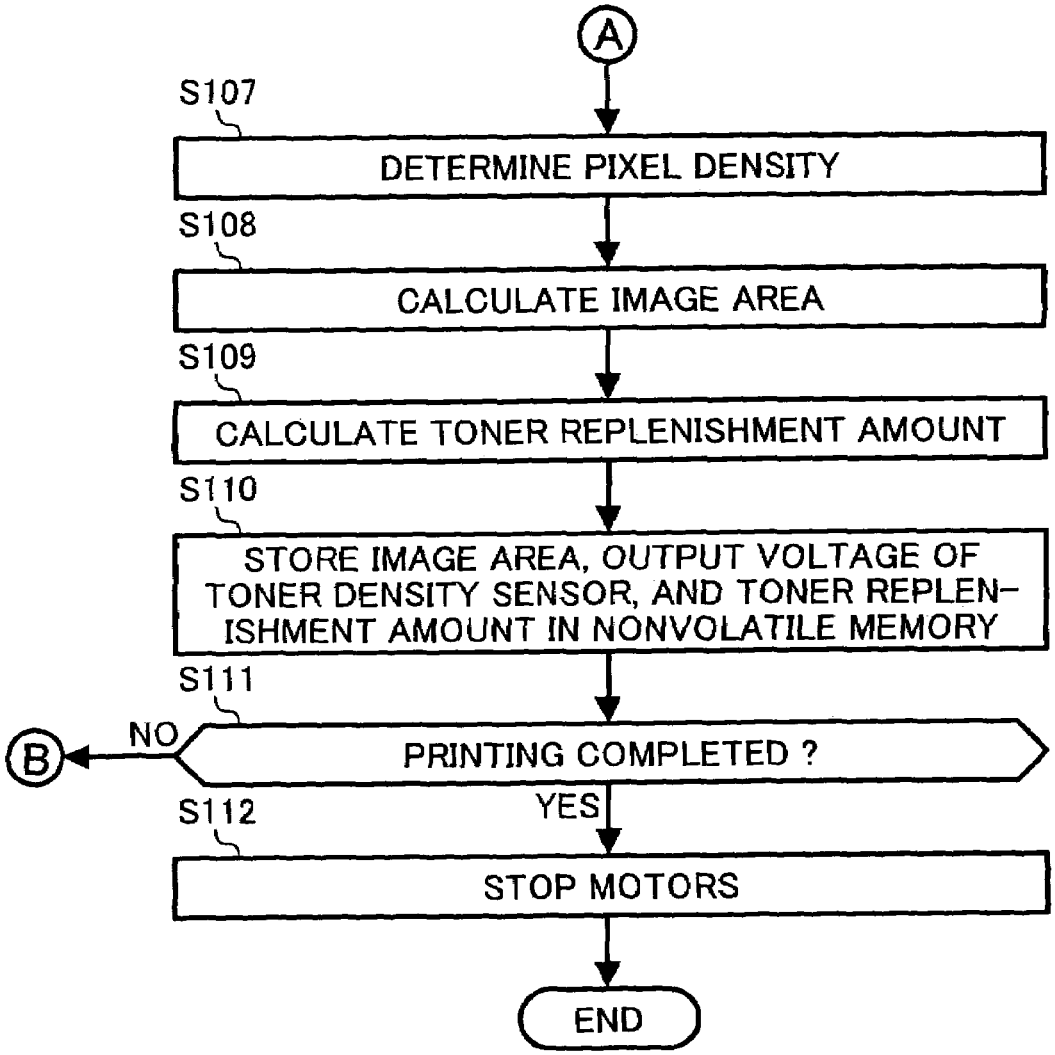

At Step S204, data of the toner replenishment amount stored in the nonvolatile memory at Step S110 shown in the flowchart of FIG. 6B is read.

At Step S205, a time period in which the toner replenishing clutch should be kept in an ON state (hereafter referred to as ON-time of the toner replenishing clutch) is calculated for each of the toner replenishing clutches. That is, an ON-time is calculated for each of the toner powder conveying pumps 9K, 9Y, 9C, and 9M. The ON-time of each of the toner replenishing clutches can be obtained from an equation of ON=TRA/RC, wherein ON is the ON-time (sec) of toner replenishing clutch, TRA is a toner replenishment amount (mg), and RC is per-unit-time toner replenishing capacity (mg/sec) of the toner replenishing clutch.

At Step S206, the toner replenishing clutches are turned on. The toner replenishing clutches are turned on based on respective ON-times of the toner replenishing clutches obtained at Step S205, and the toner powder pumps 9K, 9Y, 9C, and 9M are driven.

At Step S207, the toner replenishing clutches are kept in the ON state (i.e., the toner powder conveying pumps 9K, 9Y, 9C, and 9M are driven) for the respective ON-times obtained at Step S205, i.e., until the ON-time elapses. The toner is replenished in the respective development devices 50K, 50Y, 50C, and 50M by the corresponding toner powder conveying pumps 9K, 9Y, 9C, and 9M. As illustrated in FIGS. 4A and 4B, in each of the development devices 50K, 50Y, 50C, and 50M, the toner is conveyed in a loop-shaped path, mixed with carrier, and conveyed onto a corresponding one of the magnet rollers (i.e., the development rollers 54K, 54Y, 54C, and 54M).

At Step S209, it is determined whether the printing operation has completed. If it is determined that the printing operation has completed, operation of the group of motors is stopped in Step S210. If it is determined that the printing operation has not yet completed, the Steps S103 through S110 are repeated in a next printing operation.

At Step S210, the operation of the group of motors is stopped. When Step S209 has finished, the charging bias voltage applying devices, the development bias voltage applying devices, and the transfer bias voltage applying devices are turned off. Further, the polygon motor 606, the photoconductor drive motors, the development motors, and the transfer belt drive motor are turned off.

Figure 8:
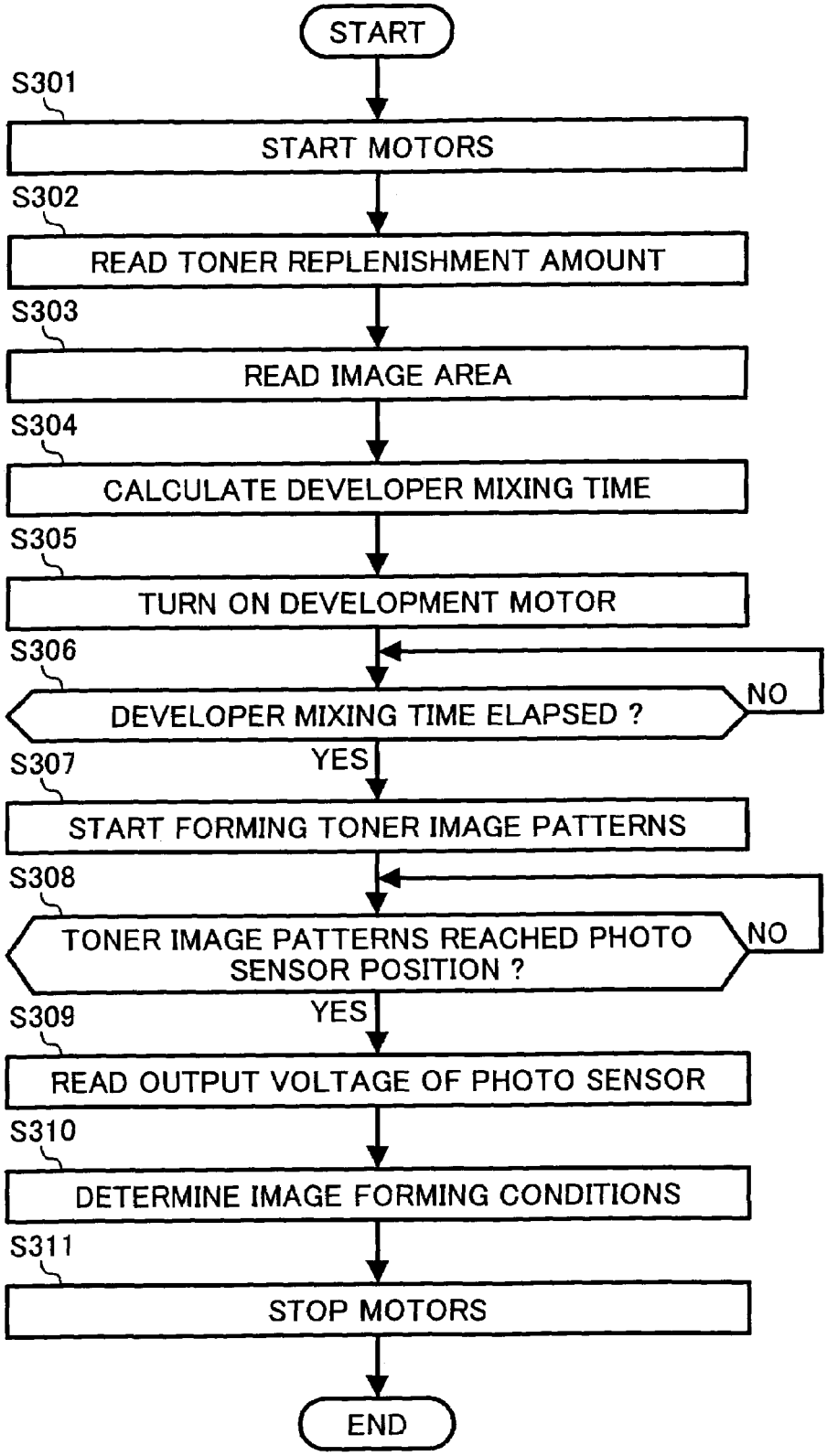
FIG. 8 is a flowchart describing a procedure of executing toner density control.

An execution procedure of controlling the toner density is described with reference to a flowchart of FIG. 8.

At Step S301, the group of motors are driven. An operation of controlling the toner density is executed under such circumstances as at power-on of the image forming apparatus 100 and after printing a predetermined number of recording medium 2. When the operation of controlling the toner density starts, the polygon motor 606 is turned on. After the polygon motor 606 has entered into the steady state, the photoconductor drive motors, the development motors, and the transfer belt drive motor are turned on. Further, the charging bias voltage applying devices apply charging bias voltages to the respective charging devices 30K, 30Y, 30C, and 30M. The development bias voltage applying devices apply development bias voltages to the spaces formed between the respective development rollers 54K, 54Y, 54C, and 54M and their opposed photoconductor drums 20K, 20Y, 20C, and 20M. The transfer bias voltage applying devices apply transfer bias voltages to the respective transfer rollers 7K, 7Y, 7C, and 7M.

At Step S302, data of the toner replenishment amount, which is stored in the non-volatile memory according to the procedure of Step S110 shown in FIG. 6B, is read.

At Step S303, data of the image area, which is stored in the non-volatile memory according to the procedure of Step S110 shown in FIG. 6B, is read.

At Step S304, the developer mixing time is calculated. The toner replenishment amount or a toner density stability time constant for the image area is calculated in advance based on results of experiments. The developer mixing time required for evenly mixing the developer is calculated from an approximation formula, for example, by using the toner replenishment amount read at Step S302 and the image area read at Step S303.

An example of the calculation of the developer mixing timer is described with reference to a graph of FIG. 10 which shows results of experiments. In those experiments, 0 milligram of toner, 100 milligrams of toner, 200 milligrams of toner, and 300 milligrams of toner are replenished from toner cartridge 60M into the development device 50M through the toner conveying pipe 607M in the direction indicated by the arrow 601 shown in FIG. 5. The graph of FIG. 10 indicates a relationship between a time in which mixing screws (i.e., the left conveying screw 52M and the right conveying screw 53M) are rotated and changes in the toner density of the developer in the vicinity of the development roller 20M. It is observed from this time chart that the toner density increases almost at one time immediately after toner replenishment but stabilizes over time. It is also observed that a degree of increase in the toner density and a time constant required for stabilizing the toner density increase in proportion to the toner replenishment amount. For example, the toner density increases more sharply immediately after the toner replenishment and more time is taken for the toner density to stabilize in a case in which the toner replenishment amount is 300 milligrams than in a case in which the toner replenishment amount is 100 milligrams.

It was also discovered from the experiments that the time constant increases as the developer deteriorates. There is a tendency that, as the developer is used for a longer time period, a longer time is taken for stabilizing the toner density. This tendency is observed in a graph of FIG. 11, for example. An increase rate of the toner density immediately after the toner replenishment is higher and more time is taken for the toner density to stabilize in a case in which the developer is replenished with 300 milligrams of additional toner after 50000 pages of the recording medium 2 have been printed (i.e., after the developer has been used for 50000 pages of printing) than in a case in which the developer is replenished with 300 milligrams of additional toner after 10000 pages of the recording medium 2 have been printed (i.e., after the developer has been used for 10000 pages of printing). This result is considered to be caused by a decrease in charging ability of the developer and a decrease in an amount of carrier included in the developer, which are caused by repeated use of the developer.

The developer mixing time is appropriately obtained based on results of the experiments. The time taken since the toner replenishment until stabilization of the toner density is proportional to the developer mixing time. The developer mixing time is, therefore, obtained by multiplying the toner replenishment amount by a stabilization coefficient. For example, if the stabilization coefficient is set to be 0.2, and if the toner replenishment amount is 100 milligrams, the developer mixing time is twenty seconds.

As described above, the time constant increases as a developer use history (i.e., the number of pages printed with a developer) increases. Therefore, the developer mixing time may be alternatively obtained by taking the developer use history into consideration, i.e., by using an equation of MT=TRA*VT*ST, wherein MT is the developer mixing time, TRA is a toner replenishment amount, VT is a value obtained from a developer use history look-up table, and ST is a stabilization coefficient. The developer use history look-up table provides values predetermined for respective numbers of printed pages, which may be determined in advance based on the results of experiments. For example, the developer use history look-up table may be set to provide a value 1.0 for the printed page number of 0 and a value 1.1 for the printed page number of 10000.

Figure 10:
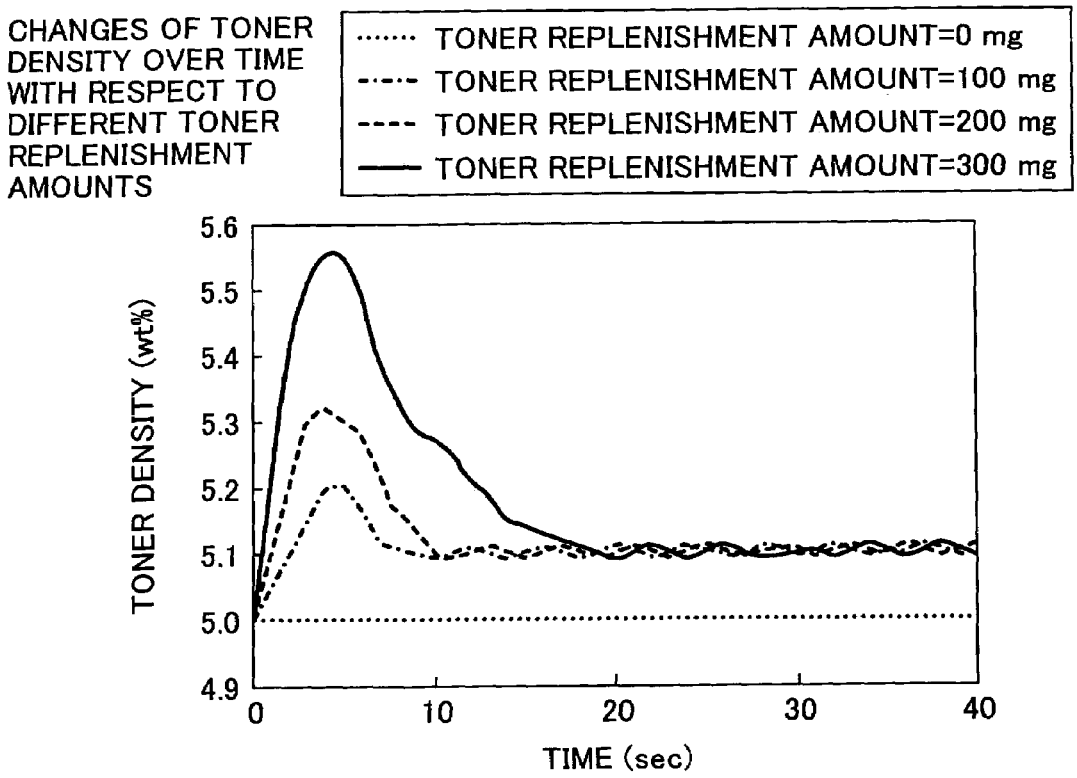
FIG. 10 is a graph illustrating relationships between toner replenishment amounts and times required for stabilizing toner density.
Figure 11:
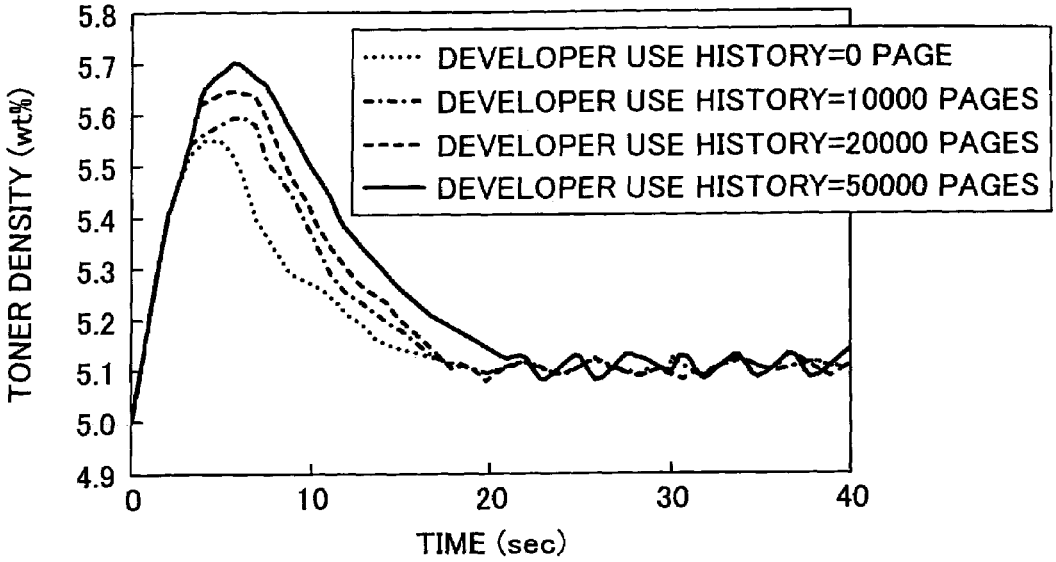
FIG. 11 is a graph illustrating relationships between developer use histories and times required for stabilizing the toner density.

As illustrated in the graphs of FIGS. 10 and 11, if the toner replenishment amount of the toner replenished from the toner cartridge 60M through the toner conveying pipe 607M into the development device 50M in the direction of the arrow 601 shown in FIG. 5 is used as a parameter, for example, the toner density increases immediately after the toner replenishment and then stabilizes.

Figure 12:
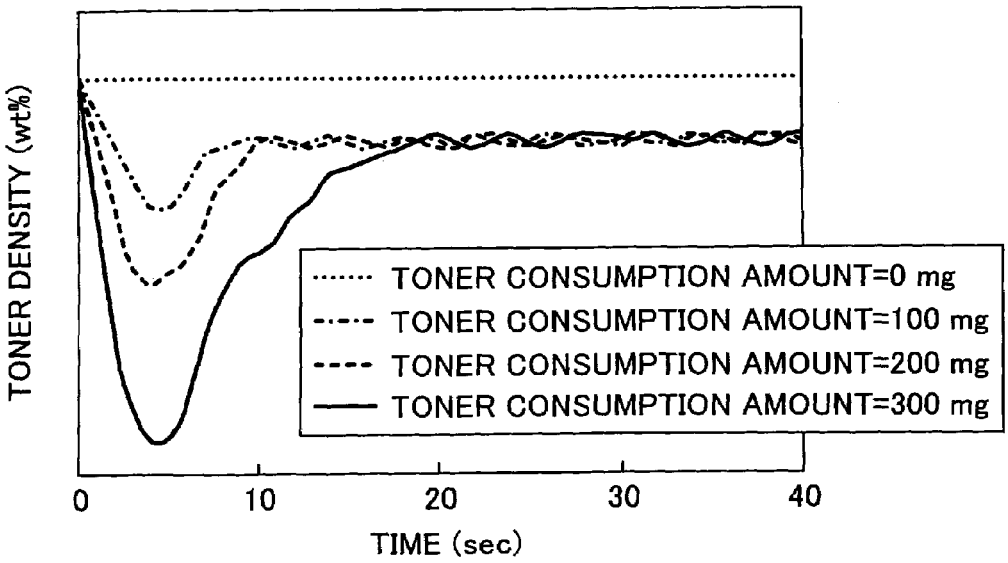
FIG. 12 is a graph illustrating relationships between toner consumption amounts and times required for stabilizing the toner density.

Alternatively, the image area may be used as a parameter. For example, in the vicinity of the development roller 54M, the toner density of the developer changes, i.e., toner moves from the development roller 54M to the photoconductor drum 20M in the development process and thus the toner density of the developer around the development roller 54M temporarily decreases. As a result, if the image area is used as a parameter, relationships between the changes in the toner density and the times required for stabilizing the toner density with respect to toner consumption amounts are represented by waveforms shown in FIG. 12, which look like a reverse version of the waveforms shown in FIG. 10. As observed in FIG. 12, when the image area is used as a parameter, the toner density decreases immediately after an image forming operation and then stabilizes. In this case, the developer mixing time is obtained by multiplying the image area by a stabilization coefficient.

Either one of the developer mixing time obtained through the calculation using the toner replenishment amount and the developer mixing time obtained through the calculation using the image area can be used as the developer mixing time actually used. Alternatively, either one of the above two developer mixing times may be obtained by calculation and used as the developer mixing time actually used. Still alternatively, both of the above two developer mixing times may be obtained by calculation so that either a longer time or a shorter time of the two developer mixing times is used as the developer mixing time actually used. Generally, a longer developer mixing time is more preferable to a shorter developer mixing time.

Furthermore, the developer mixing time may be set in consideration of the developer use history as well as either one or both of the toner replenishment amount and the image area.

Figure 13:
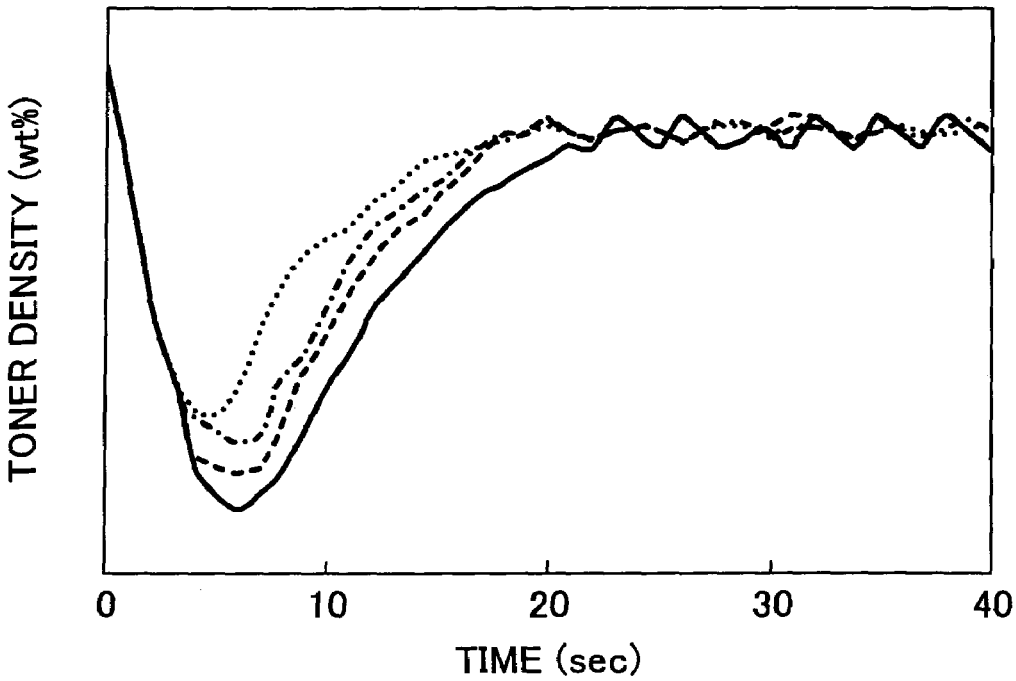
FIG. 13 is a graph illustrating relationships between developer use histories and times required for stabilizing the toner density.

With the developer use history taken into consideration, relationships between the changes in the toner density and the times required for stabilizing the toner density with respect to developer use histories are represented by waveforms shown in FIG. 13, which look like a reverse version of the waveforms shown in FIG. 11. Therefore, the developer mixing time may be obtained from an equation of MT=IA*VT*ST, wherein MT is the developer mixing time, IA is an image area, VT is a value obtained from the developer use history look-up table, and ST is a stabilization coefficient. Further, if two developer mixing times are obtained based on the image area and the toner replenishment amount, respectively, and if a longer one of the two developer mixing times is used, a more stable mixing state can be obtained.

At Step S305, the development motors are turned on. Referring to FIG. 3, for example, the development motor (not illustrated) serves as a drive source for driving such devices as the left conveying screw 52M, the right conveying screw 53M, and the development roller 54M, which involve mixing, conveyance, and supply of the developer. When the development motor is turned on, the above devices are driven, and the developer is mixed and conveyed in the loop within the casing 51M, as illustrated in FIG. 4.

At Step S306, it is determined whether the developer mixing time calculated at Step S304 (i.e., time in which the development motor operates) has elapsed. If it is determined that the developer mixing time has elapsed, the procedure advances to Step S307.

Figure 9:
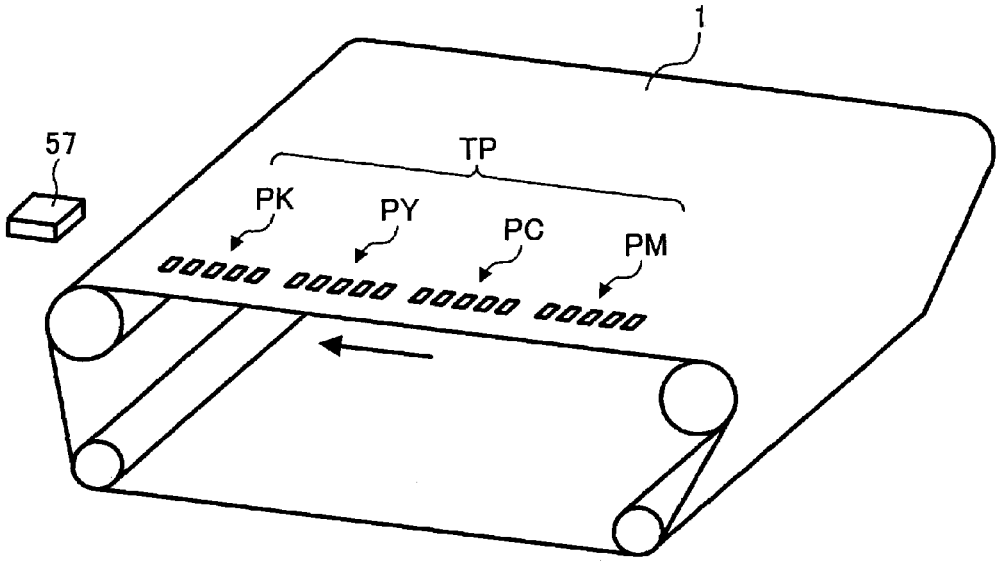
FIG. 9 is a perspective view of a transfer belt and toner image patterns formed thereon.

At Step S307, an operation of forming the toner image patterns starts for detecting the toner density. As illustrated in FIG. 9, a group TP of patterns used for determining the image forming conditions (i.e., a toner image pattern group TP in this case) is formed on a surface of the transfer belt 1. In this case, for example, the toner image pattern group TP includes four kinds of toner patterns, i.e., black toner image patterns PK, yellow toner image patterns PY, cyan toner image patterns PC, and magenta toner image patterns PM. Each of the toner image patterns has a 15-millimeter length in the main-scanning direction and a 10-millimeter length in the sub-scanning direction. Further, in each of the four kinds of toner image patterns PK, PY, PC, and PM, five toner image patterns of a toner color are formed at intervals of 5 millimeters. The toner image patterns are formed on the transfer belt 1 by transferring the toner image patterns carried on the respective photoconductor drums 20K, 20Y, 20C, and 20M to the transfer belt 1.

At Step S308, whether the toner image patterns have reached the P sensor 57 is determined. As illustrated in FIG. 9, the toner image pattern group TP including the black toner image patterns PK, the yellow toner image patterns PY, the cyan toner image patterns PC, and the magenta toner image patterns PM moves along with rotation of the transfer belt 1. When the toner image pattern group TP reaches a position where the toner image patterns included in the toner image pattern group TP are detected by the P sensor 57 provided above a path of the toner image pattern group TP, toner density values of the toner image patterns are detected by the P sensor 57. At this Step S308, it is determined whether the toner image pattern group TP has reached the position of the P sensor 57. If it is determined that the toner image pattern group TP has reached the position of the P sensor 57, the procedure advances to Step S309.

At Step S309, the output voltage output from the P sensor is read. When the toner image pattern group TP reaches the position at which the toner image patterns included in the toner image pattern group TP are detected by the P sensor 57, the toner image patterns are detected for their toner density values. Surface roughness (i.e., regular reflectance) is different between non-image areas on the transfer belt 1 and the toner image patterns formed on the transfer belt 1, and the surface roughness of the toner image patterns correlates with and changes with the toner density of the toner image patterns. Therefore, the toner density is obtained for each of the toner image patterns as an analogous value by using the above-described characteristics of the surface roughness.

At Step S310, the image forming conditions are determined. After the toner density values of the toner image patterns are obtained as analogous values, the image forming conditions are determined to appropriately adjust the actual toner density, i.e., to match the obtained analogous values with a target value. For example, when the toner image patterns are formed, toner image patterns of different densities are formed by applying different development bias voltages. Accordingly, a formula representing a relationship between the development bias voltage and the toner density is obtained.

A development bias voltage value with which the target toner density value can be obtained is calculated from the above formula, and the obtained development bias voltage is used as an image forming condition. Further, toner image patterns of different densities are formed by changing such factors as an exposure condition to appropriately maintain toner density of a halftone area and a highlighted area. Accordingly, the exposure condition is determined such that the halftone area and the highlighted area have respective target toner density values. Alternatively, a toner density target level may be controlled to appropriately maintain a development γ (gamma), which is a gradient representing a relationship between the toner density and the development bias voltage. After the image forming conditions have been determined, the image forming conditions are set.

At Step S311, operation of the group of motors is stopped. After the image forming conditions have been set, the charging bias voltage applying devices, the development bias voltage applying devices, and the transfer bias voltage applying devices are turned off. Further, the polygon motor 606, the photoconductor drive motors, the development motors, and the transfer belt drive motor are turned off.

In the above-described process of forming the toner image patterns for determining the image forming conditions, before the process of determining the image forming conditions starts (i.e., before a starting point of the process control), the image forming condition setting device calculates the developer mixing time required for resolving insufficient toner dispersion of the developer caused by a change in the toner amount in a development device (i.e., time required for evenly mixing the developer in the development device and stabilizing the toner density of the developer). The image forming condition setting device calculates this developer mixing time by taking into consideration a state of the development device, which is indicated by toner amount changing factors such as the toner replenishment amount and the image area, and the developer mixing and conveying time in which the development device is driven to operate, for example. Then, a developer mixing operation is executed for the calculated developer mixing time after the start of the process control until the start of an operation of forming the toner image patterns. Upon completion of the developer mixing operation, the toner image patterns are formed.

As described above, the developer mixing time is individually set depending on a degree of the insufficient toner dispersion, and then the developer is mixed for the developer mixing time thus set. Therefore, the downtime of the image forming apparatus 100 can be reduced, compared with in a case in which the developer mixing time is set at a fixed and relatively large value for safety. Further, according to the present embodiment, the toner image patterns are formed after the developer has been mixed for the thus set developer mixing time, and the image forming conditions are determined based on a result of detection of the thus formed toner image patterns. Thereafter, the image forming operation is performed. Accordingly, image quality of images formed according to the above procedure can be improved due to the image forming conditions appropriately set. Since the developer mixing time is thus appropriately set, the downtime of the image forming apparatus 100 can be reduced to an appropriate value, i.e., the minimum value, which is shorter than in a case in which the above-described control is not performed. Further, according to the present embodiment, a total operating time of the image forming apparatus 100 is also reduced. Therefore, lifetimes of the image forming apparatus 100 and the developer can be extended.

The image forming condition setting device individually sets the developer mixing time based on such factors as the toner replenishment amount and the image area at every start of the process control before starting the operation of forming the toner image patterns used for setting the image forming conditions. Further, the image forming condition setting device sets the developer mixing time in consideration of the use history of the developer or the development device. Then, the developer is mixed for the thus set developer mixing time, and the toner image patterns are formed. Accordingly, the developer mixing time can be appropriately set. Further, toner density detection stability can be improved and the downtime of the image forming apparatus 100 can be reduced in the present embodiment, compared with a case in which the developer mixing time is set not based on the use history of the developer or the development device. Furthermore, since a total operating time of the image forming apparatus 100 is reduced, the lifetimes of the image forming apparatus 100 and the developer can be extended.

In the above embodiment, the developer mixing time for a development device is set based on the state of the development device at the time of printing a page immediately before the process control starting point.

In another embodiment described below, the developer mixing time for a development device is set according to states of the development device during a developer mixing time required for resolving insufficient toner dispersion caused by a maximum change in the toner amount in the development device until the process control starting point. As illustrated in a time chart of FIG. 15, the sub-scanning gate signal FGATE alternately rises and falls at a constant frequency in response to exposure performed in the printing operation of each page. An exposure time t1 spent for the exposure of each page (hereinafter referred to as per-page exposure time) is set to be five seconds. As illustrated in the graph of FIG. 10, if a maximum toner replenishment amount (VSmax) of a development device is set to be 300 milligrams, twenty seconds are required as the developer mixing time, which is the minimum time required for resolving insufficient toner dispersion caused by the maximum change in the toner amount triggered by a toner replenishment of the maximum toner replenishment amount VSmax (300 milligrams) of toner, i.e., the minimum time required for stabilizing the toner density changed by the toner replenishment.

Therefore, when the maximum change in the toner amount, which causes the worst possible insufficient toner dispersion occurring in the development device, happens, changes in the toner density of the developer caused by the maximum change in the toner amount settle and the insufficient toner dispersion resolves in twenty seconds after the maximum change in the toner amount. Accordingly, when the process control is performed, changes in the toner amount should be monitored for the twenty seconds preceding the process control starting point, and then the developer mixing time should be set at a necessary value based on the monitoring.

Figure 16:
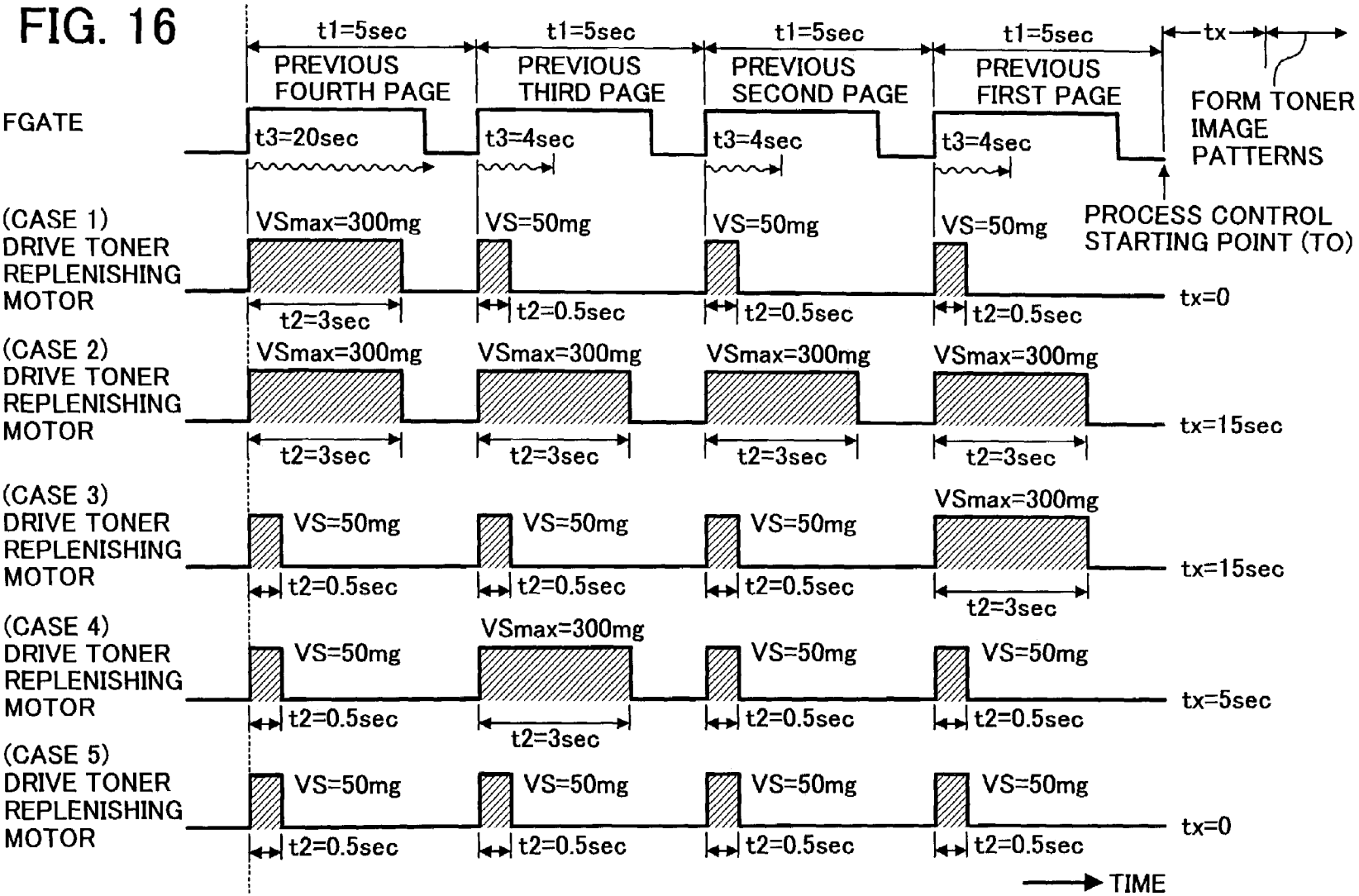
FIG. 16 is a time chart illustrating developer mixing times set for respective example cases in which the development device is in different states.

In FIG. 16, twenty seconds preceding the process control starting point TO are used for the monitoring. The per-page exposure time t1 in which the sub-scanning gate signal FGATE rises is five seconds. Therefore, toner replenishments should be monitored for a time period used for exposing four pages (i.e., a previous first page, a previous second page, a previous third page, and a previous fourth page) preceding the process control starting point TO. In the present embodiment, toner is replenished in synchronization with a rise of the sub-scanning gate signal FGATE. Further, each development device is in a continuous operation state in which the conveying screws are kept rotated to constantly mix and convey the developer.

In the following five example cases illustrated in FIG. 16, toner replenishments are performed during the time period used for exposing the four pages (i.e., the previous fourth page to the first previous page).

In a first case, the maximum toner replenishment amount VSmax (300 milligrams) of toner is replenished in synchronization with a rise of the sub-scanning gate signal FGATE in response to exposure of the previous fourth page, and thereafter a toner replenishment amount VS (50 milligrams) of toner is replenished at every rise of the sub-scanning gate signal FGATE in response to exposure of each of the subsequent pages, i.e., the previous third page, the previous second page, and the previous first page. In this case, a toner replenishment time t2 is three seconds when the maximum toner replenishment amount VSmax (300 milligrams) of toner is replenished, and a developer mixing time t3 required for settling the changes in the toner density caused by the toner replenishment is twenty seconds. Further, the toner replenishment time t2 is 0.5 seconds when the toner replenishment amount VS (50 milligrams) of toner is replenished, and the developer mixing time t3 required for settling the changes in the toner density caused by the toner replenishment is four seconds.

At the rise of the sub-scanning gate signal FGATE in response to the exposure of the previous fourth page, the maximum toner replenishment amount VSmax (300 milligrams) of toner is replenished, and thus twenty seconds are required as the developer mixing time t3.

After the per-page exposure time t1 (five seconds) has elapsed since the rise of the sub-scanning gate signal FGATE in response to the exposure of the previous fourth page, the sub-scanning gate signal FGATE rises in response to exposure of the previous third page. At this rise of the sub-scanning gate signal FGATE in response to the exposure of the previous third page, a remaining developer mixing time required in response to the toner replenishment of the maximum toner replenishment amount VSmax (300 milligrams) of toner is fifteen seconds (i.e., 20−5=15). That is, fifteen seconds are required for the developer mixing time at this stage. Further, four seconds are required as the developer mixing time t3 in response to the toner replenishment of the toner replenishment amount VS (50 milligrams) of toner. This developer mixing time t3 (four seconds) is, however, shorter than the remaining developer mixing time (fifteen seconds) in response to the toner replenishment of the maximum toner replenishment amount VSmax (300 milligrams) of toner. Therefore, this developer mixing time t3 (four seconds) can be left out of consideration. Accordingly, the developer mixing time required at the rise of the sub-scanning gate signal FGATE in response to the exposure of the previous third page is fifteen seconds.

After the per-page exposure time t1 (five seconds) has elapsed since the rise of the sub-scanning gate signal FGATE in response to the exposure of the previous third page, the sub-scanning gate signal FGATE rises in response to exposure of the previous second page. At this rise of the sub-scanning gate signal FGATE in response to the exposure of the previous second page, a remaining developer mixing time required in response to the toner replenishment of the maximum toner replenishment amount VSmax (300 milligrams) of toner is ten seconds (i.e., 15−5=10). That is, ten seconds are required for the developer mixing time at this stage. Further, four seconds are required as the developer mixing time t3 in response to the toner replenishment of the toner replenishment amount VS (fifty milligrams) of toner. This developer mixing time t3 (four seconds) is shorter than the remaining developer mixing time (ten seconds) in response to the toner replenishment of the maximum toner replenishment amount VSmax (300 milligrams) of toner. Therefore, this developer mixing time t3 (four seconds) can be left out of consideration. Accordingly, the developer should be mixed for ten more seconds.

After the per-page exposure time t1 (five seconds) has elapsed since the rise of the sub-scanning gate signal FGATE in response to the exposure of the previous second page, the sub-scanning gate signal FGATE rises in response to exposure of the previous first page. At this rise of the sub-scanning gate signal FGATE in response to the exposure of the previous first page, a remaining developer mixing time required in response to the toner replenishment of the maximum toner replenishment amount VSmax (300 milligrams) of toner is five seconds (i.e., 10−5=5). That is, five seconds are required for the developer mixing time at this stage. Further, four seconds are required as the developer mixing time t3 in response to the toner replenishment of the toner replenishment amount VS (50 milligrams) of toner. Since this developer mixing time t3 (four seconds) is shorter than the remaining developer mixing time (five seconds) in response to the toner replenishment of the maximum toner replenishment amount VSmax (300 milligrams) of toner, this developer mixing time t3 (four seconds) can be left out of consideration. Accordingly, the developer should be mixed for five more seconds.

The process control starting point TP is set to be a time point at which t1 (five seconds) has elapsed since the rise of the sub-scanning gate signal FGATE in response to the exposure of the previous first page. Therefore, the changes in the toner density caused by the changes in the toner amount have settled and the insufficient toner dispersion has been resolved before the process control starting point. Therefore, a developer mixing time tx required after the start of the process control starting point and before the start of formation of the toner image patterns is zero seconds. Accordingly, formation of the toner image patterns starts as the process control starts.

In a second case, the maximum toner replenishment amount VSmax (300 milligrams) of toner is replenished in synchronization with every rise of the sub-scanning gate signal FGATE in response to exposure of each of the four pages.

At the rise of the sub-scanning gate signal FGATE in response to the exposure of the previous fourth page, the maximum toner replenishment amount VSmax (300 milligrams) of toner is replenished, and thus twenty seconds are required as the developer mixing time t2.

After the per-page exposure time t1 (five seconds) has elapsed since the rise of the sub-scanning gate signal FGATE in response to the exposure of the previous fourth page, the sub-scanning gate signal FGATE rises in response to the exposure of the previous third page. At this rise of the sub-scanning gate signal FGATE in response to the exposure of the previous third page, a remaining developer mixing time required in response to the previous toner replenishment of the maximum toner replenishment amount VSmax (300 milligrams) of toner is fifteen seconds (i.e., 20−5=15). That is, fifteen seconds are required for the developer mixing time at this stage. Further, twenty seconds are required as the developer mixing time in response to the toner replenishment of this time, i.e., the toner replenishment of the maximum toner replenishment amount VSmax (300 milligrams) of toner. Therefore, the above two developer mixing times (fifteen seconds and twenty seconds) are compared with each other and the larger time (twenty seconds) is required as the developer mixing time actually used.

After the per-page exposure time t1 (five seconds) has elapsed since the rise of the sub-scanning gate signal FGATE in response to the exposure of the previous third page, the sub-scanning gate signal FGATE rises in response to the exposure of the previous second page. At this rise of the sub-scanning gate signal FGATE in response to the exposure of the previous second page, a remaining developer mixing time required in response to the previous toner replenishment of the maximum toner replenishment amount VSmax (300 milligrams) of toner is fifteen seconds (i.e., 20−5=15). Further, twenty seconds are required as the developer mixing time in response to the toner replenishment of this time, i.e., the toner replenishment of the maximum toner replenishment amount VSmax (300 milligrams) of toner. Therefore, the developer mixing time required at this stage is twenty seconds, which is the larger one of the above two developer mixing times (fifteen seconds and twenty seconds).

After the per-page exposure time t1 (five seconds) has elapsed since the rise of the sub-scanning gate signal FGATE in response to the exposure of the previous second page, the sub-scanning gate signal FGATE rises in response to the exposure of the previous first page. At this rise of the sub-scanning gate signal FGATE in response to the exposure of the previous first page, a remaining developer mixing time required in response to the previous toner replenishment of the maximum toner replenishment amount VSmax (300 milligrams) of toner is fifteen seconds (i.e., 20−5=15). Further, twenty seconds are required as the developer mixing time in response to the toner replenishment of this time, i.e., the toner replenishment of the maximum toner replenishment amount VSmax (300 milligrams) of toner. Therefore, the developer mixing time required at the rise of the sub-scanning gate signal FGATE in response to the exposure of the previous first page is twenty seconds, which is the larger one of the above two developer mixing times (fifteen seconds and twenty seconds).

The process control starting point TP is set to be the time point at which t1 (five seconds) has elapsed since the rise of the sub-scanning gate signal FGATE in response to the exposure of the previous first page. Therefore, the developer mixing time tx required after the start of the process control and before the start of formation of the toner image patterns is 15 seconds (20−5=15). Accordingly, formation of the toner image patterns should be started after elapse of the developer mixing time tx (fifteen seconds) since the start of the process control.

In a third case, the toner replenishment amount VS (50 milligrams) of toner is replenished in synchronization with every rise of the sub-scanning gate signal FGATE in response to exposure of each of the previous fourth page, the previous third page, and the previous second page, and thereafter the maximum toner replenishment amount VSmax (300 milligrams) of toner is replenished in synchronization with the rise of the sub-scanning gate signal FGATE in response to exposure of the previous first page.

Similarly to the above first and second cases, the developer mixing time required at the rise of the sub-scanning gate signal FGATE in response to the exposure of the previous first page is twenty seconds, which is the time required for mixing the developer in response to the toner replenishment of the maximum toner replenishment amount VSmax (300 milligrams).

The process control starting point TP is set to be the time point at which t1 (five seconds) has elapsed since the rise of the sub-scanning gate signal FGATE in response to the exposure of the previous first page. Therefore, the developer mixing time tx required after the start of the process control and before the start of formation of the toner image patterns is fifteen seconds (i.e., 20−5=15). Accordingly, formation of the toner image patterns should be started after elapse of the developer mixing time tx (fifteen seconds) since the start of the process control.

In a fourth case, the toner replenishment amount VS (50 milligrams) of toner is replenished in synchronization with the rise of the sub-scanning gate signal FGATE in response to exposure of the previous fourth page, and the maximum toner replenishment amount VSmax (300 milligrams) of toner is replenished in synchronization with the rise of the sub-scanning gate signal FGATE in response to exposure of the previous third page. Further, the toner replenishment amount VS (50 milligrams) of toner is replenished in synchronization with the rise of the sub-scanning gate signal FGATE in response to exposure of each of the previous second page and the previous first page.

At the rise of the sub-scanning gate signal FGATE in response to the previous first page, a remaining developer mixing time required in response to the toner replenishment of the toner replenishment of the maximum toner replenishment amount VSmax (300 milligrams) of toner performed at the rise of the sub-scanning gate signal FGATE in response to the exposure of the previous third page is ten seconds (i.e., 20−10=10). Further, four seconds are required as the developer mixing time t3 in response to the toner replenishment of this time, i.e., the toner replenishment of the toner replenishment amount VS (50 milligrams) of toner. Therefore, similarly to the above first to third cases, the developer mixing time required at the rise of the sub-scanning gate signal FGATE in response to the exposure of the previous first page is ten seconds, which is the larger one of the above two developer mixing times (ten seconds and four seconds).

The process control starting point TP is set to be the time point at which t1 (five seconds) has elapsed since the rise of the sub-scanning gate signal FGATE in response to the exposure of the previous first page. Therefore, the developer mixing time tx required after the start of the process control and before the start of formation of the toner image patterns is five seconds (i.e., 10−5=5). Accordingly, formation of the toner image patterns should be started after elapse of the developer mixing time tx (five seconds) since the start of the process control.

In a fifth case, the toner replenishment amount VS (50 milligrams) of toner is replenished in synchronization with every rise of the sub-scanning gate signal FGATE in response to exposure of each of the four pages. In this case, the developer mixing time t3 required in response to exposure of each of the four pages is four seconds, which is shorter than the per-page exposure time t1 (five seconds). Therefore, the developer mixing time tx required after the start of the process control and before the start of formation of the toner image patterns is zero seconds. Accordingly, formation of the toner image patterns starts as the process control starts.

As described above, the image forming condition setting device calculates the time required for mixing the developer and sufficiently dispersing toner in the developer according to the changes in the toner amount. This time is calculated, in every printing operation, when the sub-scanning gate signal FGATE rises and the exposure operation starts. The calculation continues during the developer mixing time t3 required for resolving the insufficient toner dispersion caused by the toner replenishment of the maximum toner replenishment amount VSmax of toner in a development device until the process control starting point TO. Then, the developer mixing time required at the process control starting point TO is set as the developer mixing time tx required after the process control starting point TO and before the start of formation of the toner image patterns. Accordingly, the minimum developer mixing time required for evenly mixing the developer can be set according to the states of the development device. As a result, the toner image patterns can be formed in a state in which the toner density is stabilized.

The developer mixing time can be controlled by comparing, at every rise of the sub-scanning gate signal FGATE, the developer mixing time required in response to the change in the toner density caused by a past toner replenishment, for example, and the developer mixing time required in response to the change in the toner density caused by a present toner replenishment, for example, and updating the larger one of the two developer mixing times in the memory. The developer mixing time thus updated in the memory at each rise of the sub-scanning gate signal FGATE is used as the developer mixing time required at the rise time of the sub-scanning gate signal FGATE.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. An image forming apparatus comprising:

an image forming mechanism configured to perform an image forming operation under predetermined image forming conditions, the image forming mechanism comprising:

an image carrying member configured to form an electrostatic latent image thereon;

a development device configured to develop the electrostatic latent image into a toner image; and a transfer device configured to transfer the toner image to a recording medium; and a control device configured to control an amount of toner replenished to the development device, to set a developer mixing time for evenly mixing developer in the development device by multiplying a parameter by a stabilization coefficient, to cause the development device to mix the developer for the set developer mixing time, to cause the image forming mechanism to form toner image patterns, to detect the toner image patterns, and to determine the predetermined image forming conditions based on the detection of the toner image patterns.

2. An image forming apparatus comprising:

an image forming mechanism comprising:

an image carrying member;

a charging device configured to charge the image carrying member;

an exposure device configured to expose the image carrying member to form an electrostatic latent image thereon;

a development device configured to develop the electrostatic latent image into a toner image, the development device comprising:

a mixing and conveying device configured to mix and convey developer including carrier and toner; and a development roller configured to carry and supply the mixed and conveyed developer to the image carrying member;

a transfer device configured to transfer the toner image to a recording medium; and a toner replenishing device configured to replenish toner in the development device; and a control device configured to control an amount of toner replenished to the development device, to set a developer mixing time for evenly mixing the developer in the development device by multiplying a parameter by a stabilization coefficient, to cause the development device to mix the developer for the set developer mixing time, to cause the image forming mechanism to form toner image patterns, detect the toner image patterns, and to determine predetermined image forming conditions based on the detection of the toner image patterns.

3. The image forming apparatus as described in claim 2, wherein the parameter is based on a state of the development device.

4. The image forming apparatus as described in claim 2, wherein the control device calculates, prior to a process control starting point at which a process of determining the image forming conditions starts, a time required for mixing the developer and resolving insufficient toner dispersion caused by a change in a toner amount in the development device, using the parameter and the stabilization coefficient, and sets the time obtained from the calculation at the process control starting point as the developer mixing time which starts after the process control starting point and finishes before formation of the toner image patterns.

5. The image forming apparatus as described in claim 4, wherein the control device calculates, in every printing operation during a time required for mixing the developer and resolving insufficient toner dispersion caused by a maximum change in the toner amount in the development device until the process control starting point, a time required for sufficiently dispersing toner in the developer according to a change in the toner amount, using the parameter and the stabilization coefficient, and sets the time obtained from the calculation at the process control starting point as the developer mixing time which starts after the process control starting point and finishes before formation of the toner image patterns.

6. The image forming apparatus as described in claim 2, wherein the parameter is a toner replenishment amount in the development device.

7. The image forming apparatus as described in claim 2, wherein the parameter is an image area.

8. The image forming apparatus as described in claim 2, wherein the parameter is a developer use history.

9. An image forming apparatus comprising:

means for performing an image forming operation under predetermined image forming conditions, the means for performing an image forming means comprising:

means for forming an electrostatic latent image on an image carrying member;

means for developing the electrostatic latent image into a toner image; and means for transferring the toner image to a recording medium; and means for controlling an amount of toner replenished to the means for developing, setting a developer mixing time for evenly mixing developer in the development device by multiplying a parameter by a stabilization coefficient, causing the means for developing to mix the developer for the set developer mixing time, causing the means for performing an image forming to form toner image patterns, to detect the toner image patterns, and to determine the predetermined image forming conditions based on the detection of the toner image patterns.

10. An image forming apparatus comprising:

means for forming an image comprising:

means for carrying an image;

means for charging the means for carrying;

means for exposing the means for carrying to form an electrostatic latent image thereon;

means for developing the electrostatic latent image into a toner image, the means for developing comprising:

means for mixing and conveying developer including carrier and toner; and means for carrying and supplying the mixed and conveyed developer to the means for carrying;

means for transferring the toner image to a recording medium; and means for replenishing toner in the means for developing; and means for controlling an amount of toner replenished to the means for developing, setting a developer mixing time for evenly mixing the developer in the means for developing by multiplying a parameter by a stabilization coefficient, causing the means for developing to mix the developer for the set developer mixing time, causing the means for forming an image to form toner image patterns, to detect the toner image patterns, and to determine predetermined image forming conditions based on the detection of the toner image patterns.

11. The image forming apparatus as described in claim. 10, wherein the parameter is based on a state of the means for developing.

12. The image forming apparatus as described in claim 10, wherein the means for controlling calculates, prior to a process control starting point at which a process of determining the image forming conditions starts, a time required for mixing the developer and resolving insufficient toner dispersion caused by a change in a toner amount in the means for developing, using the parameter and the stabilization coefficient, and sets the time obtained from the calculation at the process control starting point as the developer mixing time which starts after the process control starting point and finishes before formation of the toner image patterns.

13. The image forming apparatus as described in claim 12, wherein the means for controlling calculates, in every printing operation during a time required for mixing the developer and resolving insufficient toner dispersion caused by a maximum change in the toner amount in the means for developing until the process control starting point, a time required for sufficiently dispersing toner in the developer according to a change in the toner amount, using the parameter and the stabilization coefficient, and for setting the time obtained from the calculation at the process control starting point as the developer mixing time which starts after the process control starting point and finishes before formation of the toner image patterns.

14. The image forming apparatus as described in claim 10, wherein the parameter is a toner replenishment amount in the means for developing.

15. The image forming apparatus as described in claim 10, wherein the parameter is an image area.

16. The image forming apparatus as described in claim 10, wherein the parameter is a developer use history.

17. An image forming method comprising:

controlling an amount of toner replenished;

setting a developer mixing time for evenly mixing developer by multiplying a parameter by a stabilization coefficient;

mixing the developer for the set developer mixing time;

forming toner image patterns;

detecting the toner image patterns; and determining predetermined image forming conditions based on the detection of the toner image patterns.

18. An image forming method comprising:

providing an image forming mechanism configured to perform an image forming operation under predetermined image forming conditions, and a providing control device;

providing the image forming mechanism with an image carrying member, a charging device, an exposure device, a development device, a transfer device, and a toner replenishing device; and causing the control device to control an amount of toner replenished to the development device, set a developer mixing time for evenly mixing the developer in the development device by multiplying a parameter by a stabilization coefficient, cause the development device to mix the developer for the set developer mixing time, cause the image forming mechanism to form toner image patterns, detect the toner image patterns, and determine predetermined image forming conditions based on the detection of the toner image patterns.

19. The image forming method as described in claim 18, wherein the parameter is based on a state of the development device.

20. The image forming method as described in claim 18, further comprising:

calculating, prior to a process control starting point at which a process of determining the image forming conditions starts, a time required for mixing the developer and resolving insufficient toner dispersion caused by a change in a toner amount in the development device, using the parameter and the stabilization coefficient; and setting the time obtained from the calculation at the process control starting point as the developer mixing time which starts after the process control starting point and finishes before formation of the toner image patterns.

21. The image forming method as described in claim 20, further comprising:

calculating, in every printing operation during a time required for mixing the developer and resolving insufficient toner dispersion caused by a maximum change in the toner amount in the development device until the process control starting point, a time required for sufficiently dispersing toner in the developer according to a change in the toner amount, using the parameter and the stabilization coefficient; and setting the time obtained from the calculation at the process control starting point as the developer mixing time which starts after the process control starting point and finishes before formation of the toner image patterns.

22. The image forming method as described in claim 18, wherein the parameter is a toner replenishment amount in the development device.

23. The image forming method as described in claim 18, wherein the parameter is an image area.

24. The image forming method as described in claim 18, wherein the parameter is a developer use history.

25. An image forming apparatus comprising:

an image forming mechanism configured to perform an image forming operation under predetermined image forming conditions, the image forming mechanism comprising:

an image carrying member configured to form an electrostatic latent image thereon;

a development device configured to develop the electrostatic latent image into a toner image; and a transfer device configured to transfer the toner image to a recording medium; and a control device configured to control an amount of toner replenished to the development device, to set a developer mixing time for evenly mixing developer in the development device based on at least one of a toner replenishment amount in the development device, an image area, or a developer use history, to cause the development device to mix the developer for the set developer mixing time, to cause the image forming mechanism to form toner image patterns, to detect the toner image patterns, and to determine the predetermined image forming conditions based on the detection of the toner image patterns.

26. An image forming apparatus comprising:

an image forming mechanism comprising:

an image carrying member;

a charging device configured to charge the image carrying member;

an exposure device configured to expose the image carrying member to form an electrostatic latent image thereon;

a development device configured to develop the electrostatic latent image into a toner image, the development device comprising:

a mixing and conveying device configured to mix and convey developer including carrier and toner; and a development roller configured to carry and supply the mixed and conveyed developer to the image carrying member;

a transfer device configured to transfer the toner image to a recording medium; and a toner replenishing device configured to replenish toner in the development device; and a control device configured to control an amount of toner replenished to the development device, to set a developer mixing time for evenly mixing the developer in the development device based on at least one of a toner replenishment amount in the development device, an image area, or a developer use history, to cause the development device to mix the developer for the set developer mixing time, to cause the image forming mechanism to form toner image patterns, detect the toner image patterns, and to determine predetermined image forming conditions based on the detection of the toner image patterns.

27. An image forming apparatus comprising:

means for performing an image forming operation under predetermined image forming conditions, the means for performing an image forming means comprising:

means for forming an electrostatic latent image on an image carrying member;

means for developing the electrostatic latent image into a toner image; and means for transferring the toner image to a recording medium; and means for controlling an amount of toner replenished to the means for developing, setting a developer mixing time for evenly mixing developer in the development device based on at least one of a toner replenishment amount in the development device, an image area, or a developer use history, causing the means for developing to mix the developer for the set developer mixing time, causing the means for performing an image forming to form toner image patterns, to detect the toner image patterns, and to determine the predetermined image forming conditions based on the detection of the toner image patterns.

28. An image forming apparatus comprising:

means for forming an image comprising:

means for carrying an image;

means for charging the means for carrying;

means for exposing the means for carrying to form an electrostatic latent image thereon;

means for developing the electrostatic latent image into a toner image, the means for developing comprising:

means for mixing and conveying developer including carrier and toner; and means for carrying and supplying the mixed and conveyed developer to the means for carrying;

means for transferring the toner image to a recording medium; and means for replenishing toner in the means for developing; and means for controlling an amount of toner replenished to the means for developing, setting a developer mixing time for evenly mixing the developer in the means for developing based on at least one of a toner replenishment amount in the development device, an image area, or a developer use history, causing the means for developing to mix the developer for the set developer mixing time, causing the means for forming an image to form toner image patterns, to detect the toner image patterns, and to determine predetermined image forming conditions based on the detection of the toner image patterns.

29. An image forming method comprising:

controlling an amount of toner replenished;

setting a developer mixing time for evenly mixing developer based on at least one of a toner replenishment amount in the development device, an image area, or a developer use history;

mixing the developer for the set developer mixing time;

forming toner image patterns;

detecting the toner image patterns; and determining predetermined image forming conditions based on the detection of the toner image patterns.

30. An image forming method comprising:

providing an image forming mechanism configured to perform an image forming operation under predetermined image forming conditions, and a providing control device;

providing the image forming mechanism with an image carrying member, a charging device, an exposure device, a development device, a transfer device, and a toner replenishing device; and causing the control device to control an amount of toner replenished to the development device, set a developer mixing time for evenly mixing the developer in the development device based on at least one of a toner replenishment amount in the development device, an image area, or a developer use history, cause the development device to mix the developer for the set developer mixing time, cause the image forming mechanism to form toner image patterns, detect the toner image patterns, and determine predetermined image forming conditions based on the detection of the toner image patterns.

* * * * *